US010859286B2

(12) United States Patent
Dorste et al.

(10) Patent No.: US 10,859,286 B2
(45) Date of Patent: Dec. 8, 2020

(54) COMBINED ECONOMIZER AND MIXER FOR AIR HANDLING UNIT

(71) Applicant: Blender Products, Inc., Denver, CO (US)

(72) Inventors: David Charles Dorste, Boulder, CO (US); Mark Jeffrey Pavol, Arvada, CO (US); Kevin Deems, Northglenn, CO (US)

(73) Assignee: BLENDER PRODUCTS, INC., Denver, CO (US)

( * ) Notice: Subject to any disclaimer, the term of this patent is extended or adjusted under 35 U.S.C. 154(b) by 198 days.

(21) Appl. No.: 15/366,786

(22) Filed: Dec. 1, 2016

(65) Prior Publication Data

US 2017/0153039 A1 Jun. 1, 2017

Related U.S. Application Data

(63) Continuation-in-part of application No. 14/954,897, filed on Nov. 30, 2015.

(51) Int. Cl.
*F24F 13/04* (2006.01)
*F24F 13/22* (2006.01)
(Continued)

(52) U.S. Cl.
CPC ..... *F24F 13/04* (2013.01); *F24F 11/0001* (2013.01); *F24F 11/30* (2018.01);
(Continued)

(58) Field of Classification Search
CPC ..... F24F 13/04; F24F 11/0001; F24F 13/12; F24F 2011/0002; F24F 11/30;
(Continued)

(56) References Cited

U.S. PATENT DOCUMENTS 4,485,632 A * 12/1984 Gallagher ..... F24F 11/30 62/179
4,793,247 A 12/1988 Verweij
(Continued)

OTHER PUBLICATIONS

Prior Art Rosemex Climatair Central Station Air Handling Unit catalogue (53 pages).
(Continued)

*Primary Examiner* — Tho V Duong
*Assistant Examiner* — Raheena R Malik
(74) *Attorney, Agent, or Firm* — Berg Hill Greenleaf Ruscitti LLP

(57) ABSTRACT

An air mixing device mitigates temperature stratification between two incoming air streams by creation of turbulent airflow through an arrangement of channels in the device. The device also provides selective passage of air for incoming airstreams to achieve functionality for damper control typically associated with separate inlet dampers. Static mixing plates may be employed to affect desired mixing through the device. A method provides for selectively controlled airflow through the device so effective mixing occurs along with an economizer function to control separate airstreams such as outside air and return air. Existing dampers may be integrated with the air mixing device to control airflow in which flow of one airstream through the device increases as the flow of the other airstream is proportionately decreased.

17 Claims, 22 Drawing Sheets

(51) Int. Cl.

| | |
|---|---|
| ***F24F 11/00*** | (2018.01) |
| ***F24F 13/12*** | (2006.01) |
| ***F24F 11/79*** | (2018.01) |
| ***F24F 11/30*** | (2018.01) |
| *F24F 110/20* | (2018.01) |
| *F24F 110/10* | (2018.01) |
| *F24F 110/22* | (2018.01) |
| *F24F 110/12* | (2018.01) |

(52) U.S. Cl.
CPC ..... *F24F 11/79* (2018.01); *F24F 13/12* (2013.01); *F24F 13/222* (2013.01); *F24F 2011/0002* (2013.01); *F24F 2110/10* (2018.01); *F24F 2110/12* (2018.01); *F24F 2110/20* (2018.01); *F24F 2110/22* (2018.01)

(58) Field of Classification Search
CPC ..... F24F 11/79; F24F 13/222; F24F 2110/20; F24F 2110/22; F24F 2110/10; F24F 2110/12
USPC ..... 165/249; 454/258
See application file for complete search history.

(56) References Cited

U.S. PATENT DOCUMENTS

| | | | | | |
|---|---|---|---|---|---|
| 4,962,882 | A * | 10/1990 | Sarazen, Jr. | F24F 13/15 | 236/49.5 |
| 4,986,170 | A | 1/1991 | Ramakrishnan et al. | | |
| 5,184,600 | A * | 2/1993 | Astle, Jr. | F24H 3/065 | 110/185 |
| 5,463,967 | A | 11/1995 | Gielow et al. | | |
| 5,536,207 | A | 7/1996 | Robinson et al. | | |
| 5,547,018 | A * | 8/1996 | Takahashi | F24F 1/0011 | 165/122 |
| 5,645,481 | A | 7/1997 | Robinson et al. | | |
| 6,241,601 | B1 | 6/2001 | Han et al. | | |
| 6,244,954 | B1 * | 6/2001 | Hosokawa | F24F 1/0007 | 454/202 |
| 6,338,382 | B1 * | 1/2002 | Takahashi | F24F 1/0007 | 165/119 |
| 6,547,433 | B2 | 4/2003 | Yazici et al. | | |
| 6,595,848 | B1 | 7/2003 | Robinson | | |
| 6,688,966 | B2 | 2/2004 | Akhtar | | |
| 6,878,016 | B2 | 7/2005 | Wulff et al. | | |
| 6,920,959 | B2 | 7/2005 | Han et al. | | |
| 8,789,766 | B2 * | 7/2014 | Baldauf | B64D 13/00 | 137/3 |
| 2002/0126572 | A1 | 9/2002 | Yazici et al. | | |

OTHER PUBLICATIONS

Prior Art Ruskin® Specification Sheet for CD60 (4 pages).
Screenshots of Blender Products Website, retrieved from http://www.blenderproducts.com/ (10 pages).
Canadian Office Action dated Feb. 26, 2019 in Canadian Application No. 2,986,847, filed on Nov. 27, 2017, 3 pages.
Canadian Office Action dated Feb. 28, 2019 in Canadian Application No. 2,986,782, filed on Nov. 27, 2017, 4 pages.

* cited by examiner 100
105
106
104
102
102
102

COMBINED ECONOMIZER AND MIXER FOR AIR HANDLING UNIT

CROSS REFERENCE TO RELATED APPLICATIONS

This application is a continuation in part of U.S. patent application Ser. No. 14/954,897 filed on Nov. 30, 2015 and entitled "Combined Economizer and Mixer for Air Handling Unit" which is incorporated by reference herein in its entirety.

FIELD OF THE INVENTION

The invention relates to air handling units used for heating, cooling, and ventilating of interior air spaces, and more particularly, to a device that has combined attributes of both a static mixer and an air inlet damper control used within an air entry portion or mixing box of the air handling unit. The invention also relates to a method of optimizing controlled temperature airflow in an air handling unit.

BACKGROUND OF THE INVENTION

Air handling units for commercial buildings are required to move air within large interior air spaces within the buildings. The proper movement of air within these spaces is required to adequately ventilate the interior spaces and to selectively heat and cool the air space in response to environmental conditions. Depending upon the size of the building, there may be multiple air handling units required, and a substantial amount of energy may be consumed in providing the needed environmental control within the buildings.

Many air handling units have what is referred to as a "mixing box," which is a confined area which first receives fresh air or ventilation air from the outside into the building and may also receive the return air or recirculated air from the building. Outside air can be used to supplement cooling within the building if the outside air is cooler than the return air entering the air handler unit. The mixing of return air and outside air can be referred to as an "economizing" cycle in which the use of outside air replaces air cooled by mechanical cooling within the air handling unit. For example, cooling within the air handling unit may include use of a chilled water loop or direct expansion refrigeration to remove heat from the recirculated air. These cooling means require energy for cooling; therefore, supplementing required cooling with outside air saves energy. So long as the outside air is at a lower temperature than the return air from the building, some incremental amount of energy can be saved by mixing the outside air with the return air.

An economizer control may be installed within the mixing box to achieve an economizing cycle. The economizer includes two sets of dampers which are installed to control airflow into the mixing box. One set of dampers is positioned to control entry of air from the outside, and another set of dampers is positioned to control entry of air from the return air duct. Temperature sensors within the air handling unit are used to determine the temperature differential between the return air and the outside air. The positions of the two sets of dampers are then controlled to optimize the volume of air that passes through the dampers based upon air temperature requirements within the building. For example, if the outside air is significantly cooler than the return air and there is a need to cool the air within the interior airspace of the building, the set of dampers for controlled entry from the outside may be wide open, while the dampers controlling the return air may be closed. Conversely, if the temperature outside is higher than the return air and there is a need for cooling within the interior airspace, then the set of dampers for controlling entry from the outside may be closed, and the set of dampers for controlling airflow from the return air may be wide open. Incremental changes can be made to the position of the dampers for selectively altering the amount the dampers are open or closed and to thereby optimize an economizing function.

One problem associated with airflow entering an air handling unit is that there is typically some amount of temperature stratification of the airstream. When return air and outdoor air simultaneously enter an air handling unit, there is some inherent temperature stratification because the return air and outdoor air are two separate air streams at different respective temperatures, and there cannot be complete mixing of the separate air streams within the mixing box. There are a number problems associated with temperature stratification. Temperature stratification can damage cooling coils when portions of the airstream are at unacceptably cold temperatures, can cause nuisance system shutdowns because of temperature measurements that only measure a portion of the airstream, and can cause generally inefficient control system performance because air temperature and humidity measurements are not capable of accurately measuring these parameters due to the different temperature and humidity conditions found within the stratified airstream at any particular time.

In order to reduce airflow stratification, it is known to place air mixers or air blenders within the mixing box upstream of the filter banks. Air mixers may include stationary or moving blades/vanes which produce a turbulent airflow to mix the passing airstream. One group of air blenders, which are marketed and sold by Blender Products, Inc., include those which are disclosed in the U.S. Pat. Nos. 5,536,207; 5,645,481; 6,595,848, and 6,878,016. Commercial devices covered by these patents have been proven to be very effective in mixing a stratified airstream and therefore greatly enhance the efficiency of the air handling unit.

Despite the number of different air mixers or air blenders which may be available, one general drawback is that these devices create a pressure drop as the airstream passes through the devices, which increases the load on the air handler fan to keep an adequate flow of air moving through the unit. Additionally, for some air mixers, they require an additional distance for separate air masses to effectively mix; therefore, some modifications may be required to the duct work associated with the air handling unit for the air mixers to perform to specifications.

Another problem associated with most air handling units is that they fail to allow airflow to maintain sufficient velocity through the dampers located at the entrance of the mixing box. More specifically, an air handling unit is deliberately sized to slow down air traveling through the unit so that air passing through the unit may be sufficiently heated or cooled by contact of the airstream with the respective heating or cooling heat exchangers. This slower velocity prevents the stratified return air and outdoor air streams from effectively mixing within the mixing box. Therefore, there is a trade-off between maintaining an airstream at a sufficiently slow velocity such that effective heat exchange can take place and maintaining the airstream at a sufficiently high velocity such that stratified airstreams may adequately mix. Ideally, it would be preferable to provide an air handling unit which can achieve optimal airflow velocity so that both heat exchange and mixing could occur without additional loading of the air handling fan or additional energy used for the heating/cooling coils of the air handling unit.

Accordingly, there is a need to provide a device and method for effectively mixing stratified airstreams entering a mixing box of an air handling unit and to take advantage of an economizing cycle, but minimizing additional energy requirements.

SUMMARY OF THE INVENTION

In a first preferred embodiment, the invention is a device that combines the functionality of temperature mixing by use of structure in the device which mitigates temperature stratification by creation of turbulent airflow, and provides damper control associated with inlet dampers of a mixing box. Structurally, the device can be described as having a housing that enables the device to be mounted within a mixing box of an air handling unit, the housing being sized to occupy the opening through which outdoor air and return air travel through the mixing box. A plurality of channels is formed in the housing and which delimit the areas through which the return air and outdoor air travel through the device. In one preferred configuration, the channels are configured in a side-by-side arrangement, and extend vertically. A plurality of ribs or supports determines the size and shape of the channels in which the channels are formed between each pair of ribs. The ribs may be selected from a desired cross-sectional shape to influence airflow through the device which optimizes mixing. Further, the leading or front face of the device may be angled to further optimize airflow through the device for mixing purposes. For example, instead of the front face of the device simply extending vertically, it is contemplated that the front face could be angled or tilted to further influence the direction of airflow.

To selectively control the volume of air passing through the device and to selectively control a selected airstream (e.g., return air, outdoor, or combinations of both), a slotted cover plate is provided and is mounted to the front or downstream face of the device. The slotted cover plate may be shifted or moved such that the amount of open area through the channels is determined by alignment or misalignment of the slots in the cover plate. More specifically, the slots in the cover plate may be sized and shaped to generally match the channels such that in an aligned position, the slots do not block passage of air through the channels. Conversely in a blocked position, the cover plate may be shifted so that the cover plate substantially covers each of the channels. The cover plate may also be placed between these two positions, such that a desired amount of air flow through the device and from the selected portion(s) of the airstreams may be controlled.

To effectively attach the cover plate with respect to the front face of the device, a plurality of seals may be provided to prevent air from escaping between the edges of the channels and slots as they may be positioned.

The device may be more specifically mounted within the economizer section of an air handling unit; that is, within the portion of the air handling which receives return air and outside air, which may be a mixing box or another larger interior open area as compared to the ducts which communicate with the mixing box to deliver the outside air and return air. Preferably, the device is mounted such that it will completely cover the passages or ducts that convey the return air and outside air to the air handling unit. In this way, better control can be provided for airflow through the unit.

According to another aspect of the invention, turning vanes can be incorporated within the device in order to direct the flow of air towards the desired area of the mixing box or mixing plenum. The turning vanes can be installed within the channels of the device and in a manner so that desired angles are achieved to influence both the direction of airflow and the type of turbulence generated by the passing air. The turning vanes also provide additional rigidity for the device by providing more structure interconnecting the adjacent pairs of ribs. The turning vanes can be provided in several different combinations in terms of both size and angle to cover a variety of flow rates and other conditions.

According to yet another aspect of the invention, downstream mixing blades can be provided to further influence airflow, such as to increase turbidity of the airflow downstream. The downstream mixing blades are secured to the cover plate and extend downstream. The mixing blades may be curved, planar, or bent in any desired shape to most effectively influence airflow.

According to other aspects of the invention, different configurations can be provided for the back or inlet sides of the device to influence how air flows through the device. More specifically, depending upon how the ductwork is configured, the trailing or rear surfaces of the ribs can be angled to best match the angle at which the ducts communicate with the device.

According to yet another aspect of the invention, automatic means are provided for controlling the position of the cover plate with respect to the front face of the device. This control can be achieved by several different actuators or motors which can effectively and incrementally shift the cover plate with respect to the front face of the device to which it is mounted.

According to another aspect of the invention, it may be considered a mixing device that mitigates temperature stratification by creation of turbulent air flow and is especially adapted for mounting within the mixing box of an air handling unit. According to this aspect, the mixing device does not replace the return air and outdoor air dampers, said dampers remaining installed. Accordingly, this aspect of the invention may be considered a sub-combination embodiment as compared to the first mentioned embodiment which provides both mixing and damper control functions. Another feature that may be associated with this aspect of the invention is the use of static mixing plates secured to selected edges of the ribs in lieu of providing a cover plate to control air flow rates and additional mixing. More specifically, these static mixing plates, for example, may be secured to the downstream edges of the ribs or may be attached adjacent to the downstream edges of the ribs. These static mixing plates may be sized and angled with respect to the direction of airflow to influence both airflow rates and additional mixing of the airflow. One advantage of this embodiment is that the existing damper control may be maintained, thereby minimizing structural changes to the mixing box of an air handling unit. Accordingly, the mixing device of this embodiment may be installed directly within the mixing box without any other structural changes being made to the damper controls or mixing box.

According to one aspect of the invention, the construction of the ribs and/or the type of material used to make the ribs can be modified to mitigate problems resulting from condensation in the mixing box. The plurality of the ribs as described herein create channels that separate OA and RA into vertical alternating "slices" of air. These separate slices of air as between the OA and RA will have different temperatures and (except of course when RA and OA have the same temperatures), and the temperature differential creates the opportunity for one airstream of colder temperature to "cool" the corresponding rib to potentially create condensation on the opposite side of the rib which carries an airstream of warmer more humid air. This condensation is undesirable and if left to form and coalesce, would flow and pool in the bottom of the mixer and the mixing box compartment of the air handling unit. The pooled condensation can cause rust and/or mold to form which can negatively impact the quality of the air in the building. One solution is for the ribs to incorporate longitudinal channels or "gutters" to collect coalesced condensation and thereby channel the moisture to a floor drain to prevent pooling of the water in the mixing box. Another solution is to thermally insulate the ribs to prevent heat transfer and therefore prevent the colder temperature airstream from cooling the opposite side of the rib containing the warmer and more humid air. One example of an insulated rib is a construction in which the rib has a double wall or double layer with an air gap between the layers. The air gap may alternatively be filled with an insulating material such as a foam or other material with low heat transfer coefficient properties. The ribs may be constructed of a material that also has low heat transfer properties such as a plastic or corrugated plastic sheeting material.

Considering the above features of the invention, in a first aspect, the invention may be considered an air mixing device especially adapted for mixing airstreams introduced to an air handling device and flowing through said device, said device comprising: (i) a housing; (ii) a plurality of spaced ribs secured to said housing, a plurality of corresponding channels defined as spaces between adjacent ribs; (iii) a cover plate secured to a downstream side of said housing, said cover plate having a plurality of slots formed therein; and (iv) an actuator communicating with said cover plate for selectively shifting said cover plate with respect to said channels exposed to said slots.

According to another aspect of the invention, in connection with the above-mentioned sub-combination, the invention may be considered an air mixing device especially adapted for mixing airstreams introduced to an air handling device and flowing through said device, said device comprising: (i) a housing; (ii) a plurality of spaced ribs secured to said housing, a plurality of corresponding channels defined as spaces between adjacent ribs; and (iii) a plurality of static mixing plates secured to selected ribs.

Other features of this first aspect of the invention may include: (i) wherein said plurality of spaced ribs include a first set of ribs that communicate with a first airstream introduced to the air handling device, and a second set of ribs that communicate with a second airstream introduced to the air handling device, said first set being offset from said second set so that shifting of said actuator enables controlled passage or blockage of said first said second airstreams through said mixing device; (ii) wherein said plurality of spaced ribs have a length that extend substantially in a first direction and said first and second sets of ribs are offset from one another in a second direction that is substantially perpendicular to said first direction; (iii) wherein said cover plate can be selectively and controllably shifted between (a) a first position to block airflow of a first airstream introduced to said mixing device and to allow passage of a second airstream through said mixing device; (b) a second position to block airflow of said second airstream and to allow passage of said first airstream; and (c) a selected plurality of additional positions in which said first and second airstreams are allowed to pass through said mixing device, said additional positions being defined as corresponding open areas through said slots that communicate with said channels; (iv) The mixing device further including at least one turning vane mounted between two adjacent ribs and spanning a channel located between said adjacent ribs, said turning vane oriented to alter a directional flow of an airstream passing through said channel; (v) wherein said at least one turning vane includes a plurality of turning vanes mounted between selected pairs of adjacent ribs; (vii) wherein said plurality of turning vanes each have a selected angular orientation for altering the directional flow of the airstream; (viii) further including at least one mixing blade attached to a downstream side of a selected portion of said housing, and said mixing blade extending downstream to provide additional mixing for airstreams passing through said device; (ix) wherein a shape of said mixing blade includes at least one of a curved shaped or planer shape (x) further including a plurality of seals secured to a corresponding plurality of downstream edges of said ribs, wherein said plurality of seals make sealing engagement with corresponding portions of said cover plate when said cover plate is shifted to said first and second positions; (xi) wherein said actuator includes a rack secured to said cover plate and a pinion driver communicating with said rack wherein said pinion is selectively rotated to engage said rack and to incrementally adjust a position of said cover plate (xii) wherein said actuator includes a piston and rod connected to said cover plate and a motor communicates with said piston to selectively move said rod to incrementally adjust a position of said cover plate.

According to another aspect of the invention, it may be considered an air mixing device especially adapted for mixing airstreams introduced to an air handling device and flowing through said device, said device comprising: (i) a housing; a plurality of spaced ribs secured to said housing, a plurality of corresponding channels defined as spaces between adjacent ribs; (ii) a plurality of damper elements mounted within corresponding channels; and (iii) at least one actuator communicating with said plurality of damper elements to rotate selected damper elements in order to control passage of the airstreams through the device.

According to this second aspect of the invention, other features of the invention may include (i) wherein said plurality of spaced ribs include a first set of ribs that communicate with a first airstream introduced to the air handling device, and a second set of ribs that communicate with a second airstream introduced to the air handling device, said first set being offset from said second set so that control of said damper elements enables controlled passage or blockage of said first said second airstreams through said mixing device; (ii) wherein said plurality of spaced ribs have a length that extend substantially in a first direction and said first and second sets of ribs are offset from one another in a second direction that is substantially perpendicular to said first direction; (iii) wherein said damper elements are rotatable about an axis in order to selectively control an amount of airflow which is allowed to pass through the corresponding channels (iv) wherein said damper elements have a cross-sectional shape that is substantially planar.

According to yet another aspect of the invention, it may be considered a method of mixing airstreams introduced to an air handling device and flowing through a mixing device, the method comprising: (i) providing a mixing device having (a) a housing; (b) a plurality of spaced ribs secured to said housing, a plurality of corresponding channels defined as spaces between adjacent ribs; (c) a cover plate secured to a downstream side of said housing, said cover plate having a plurality of slots formed therein, or a plurality of dampers mounted within corresponding channels; (d) an actuator communicating with said cover plate or dampers for selectively shifting said cover plate with respect to said channels exposed to said slots or to selectively rotate the plurality of dampers to create a desired amount of open space through the channels for passage of air; (ii) determining a desired temperature and/or humidity for conditioned air to be produced by the air handling device; (iii) evaluating temperatures and/or humidity of the introduced airstreams; and (iv) selectively actuating the actuator to allow a desired flow of air from the airstreams through the device for passage downstream through the air handling unit.

According to yet another aspect of the invention, it may be considered a combination of an air mixing device and air handling unit wherein said air mixing device is especially adapted for mixing airstreams introduced to the air handling unit and flowing through said unit, said combination comprising: (i) a mixing box for receiving the airstreams; (ii) an air mixing device mounted in said mixing box, said device including: (a) a housing; (b) a plurality of spaced ribs secured to said housing, a plurality of corresponding channels defined as spaces between adjacent ribs; (c) a cover plate secured to a downstream side of said housing, said cover plate having a plurality of slots formed therein; (d) an actuator communicating with said cover plate for selectively shifting said cover plate with respect to said channels exposed to said slots; (iii) a heating unit located downstream of said air mixing device; and (iv) a cooling unit located downstream of said air mixing device.

What will become more apparent from review of the following detailed description and drawings is that the device of the invention provides not only effective mixing through the channels of the device, but also provides some directional control to thereby selectively determine whether greater percentages of return air or outdoor air should pass through the device. Because of the way the upstream side of the ribs may be configured, each channel opening can be aligned with a desired airflow component since airflow can be controlled from at least two different directions. Nonetheless, effective mixing can still be achieved through the openings at the downstream side of the mixing device.

Other features and advantages of the invention will become better understood after review of the drawings taken in conjunction with the detailed description.

DETAILED DESCRIPTION

Figure 1:
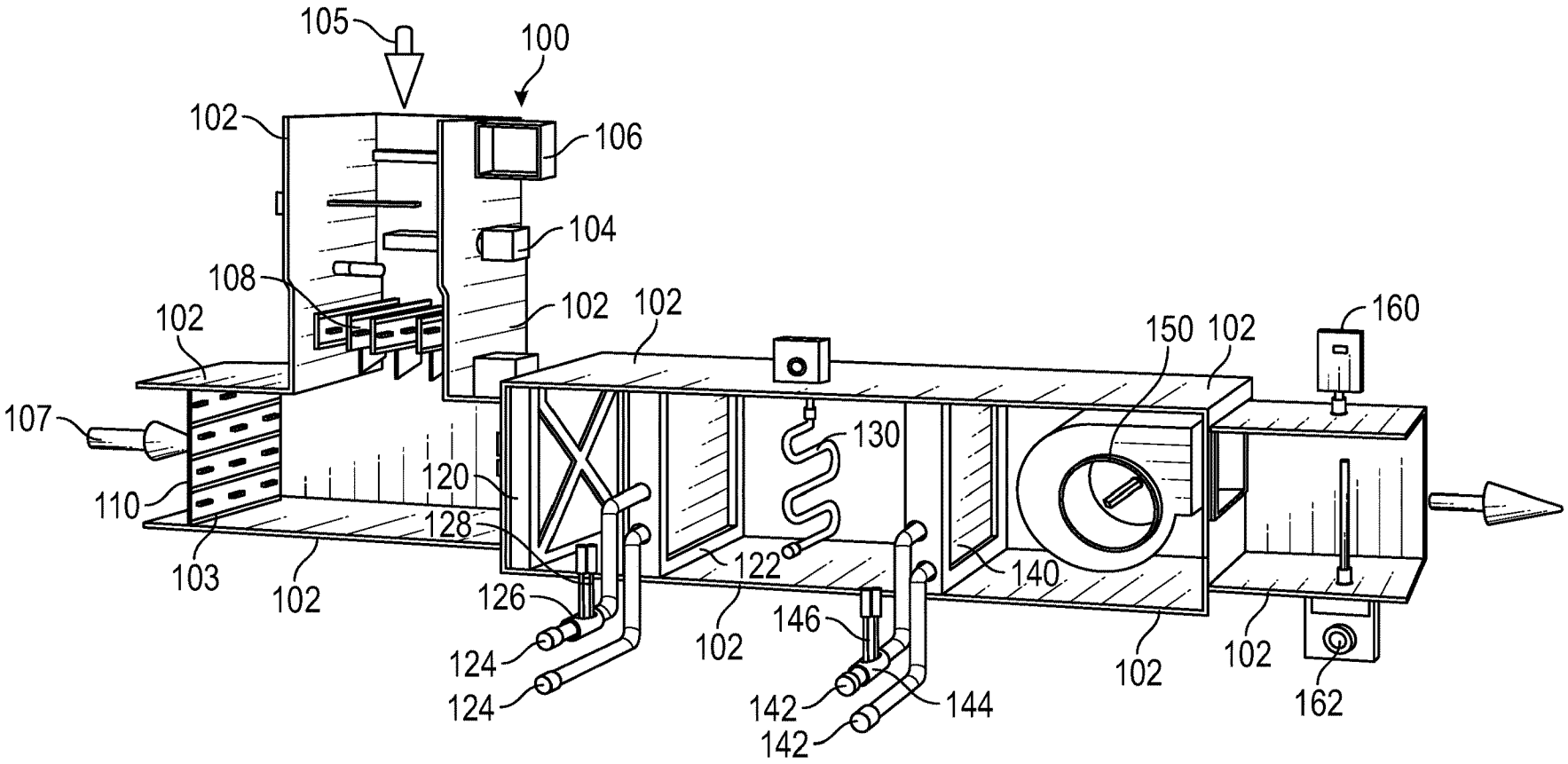
FIG. 1 is a cross-sectional view of an exemplary air handling unit which may be modified to incorporate the device of the invention.

Referring to FIG. 1, a prior art and exemplary air handling unit 100 is illustrated. The purpose of this illustration is to provide background as to the particular application of the invention, and further to describe the invention in combination with an air handling unit. Components of the unit 100 are housed within a series of ducts 102. There are two inlets or entrances to the air handling unit, namely, a return air duct 105 and an outdoor air duct 107. The directional arrows are provided noting the general direction of airflow and also denoting the respective ducts. Airflow for these ducts intersects or coincides within a mixing box 103. Within the return air duct 105, one or more sensors can be provided, such as a temperature sensor 104, a humidity sensor 106, and others. Temperature and humidity are measured at this location, and may be input to an air handler controller (not shown) in order to determine the degree to which this airstream must be conditioned. A return air damper 108 is also shown, and which may be automatically controlled in order to limit the volume of return air allowed to pass through the unit. Similarly, an outside air damper 110 is illustrated, and which may be automatically controlled in order to limit the volume of outside air to pass through the unit. Downstream of the mixing box is a filter bank 120, and the filters are used to remove particulates and other contaminants. Downstream of the filter bank is a heating coil or heating unit 122. The heating coil is used to incrementally heat air that passes through the coil, as set by the unit controller. Fluid lines 124 communicate with the heating coil to circulate heated fluid, and the flow of fluid through the lines may be controlled by a valve 126 and a valve actuator 128. Downstream of the heating coil is a "freeze stat" 130 that can be a looped temperature sensor used to measure and subsequently control overly-cooled air thereby preventing freezing of the downstream cooling coil 140. The cooling coil 140 is also shown as having its own corresponding cooling lines 142 which convey cooling fluid to the cooling coil, a valve 144, and valve actuator 146 which are used to control flow of cooling fluid. Downstream of the cooling coil is a fan 150 which is used to draw air through the unit. Finally, downstream of the fan is shown another set of temperature and humidity sensors, 160 and 162, which measure the air after it has been conditioned.

The device of the present invention is intended to optimize air mixing within the mixing box, and to replace a traditional damper design in the mixing box in favor of a damper control directly incorporated within the device. Considering these general attributes of the invention, reference is made to FIGS. 2 and 3 that illustrate a first preferred embodiment of the device of the invention. As shown, the device 10 includes a housing 12 which can be sized and shaped to fit within a desired portion of a mixing box of an air handling unit. The outer edges of the housing 12 are shown as being generally rectangular; however, it shall be understood that other shapes can be adopted in order that the device can be mounted flush with the interior surfaces of the desired portion or section of the mixing box. The particular construction of the device shown also includes side flanges 14 which may be used to help stabilize mounting of the device within a mixing box. Upper and lower surfaces of the housing are labeled as upper surface 22 and lower surface 24. A plurality of spaced ribs or supports 16 occupies a substantial portion of the interior of the housing. The gaps between the ribs 16 are defined as channels 18, and these channels define the areas to which air can flow. In FIG. 3, it is also apparent that the downstream or front face of the device may be tilted or angled in order to best transfer airflow through the particular shape or configuration of the mixing box.

Directional arrows are shown to illustrate how to separate airstreams may pass through the device. The horizontal sets of directional airflow arrows 25 may represent either return air or outside air, while the vertical sets of directional airflow arrows 27 may represent either as well, each depending upon how ductwork is oriented in relation to the position of the air handling unit. The resultant combined airstream that passes through the device is represented by the directional airflow arrows 29. The particular angle at which the air passes through the device based upon the disposition of the front face of the ribs can be defined as angle 20.

Figure 2:
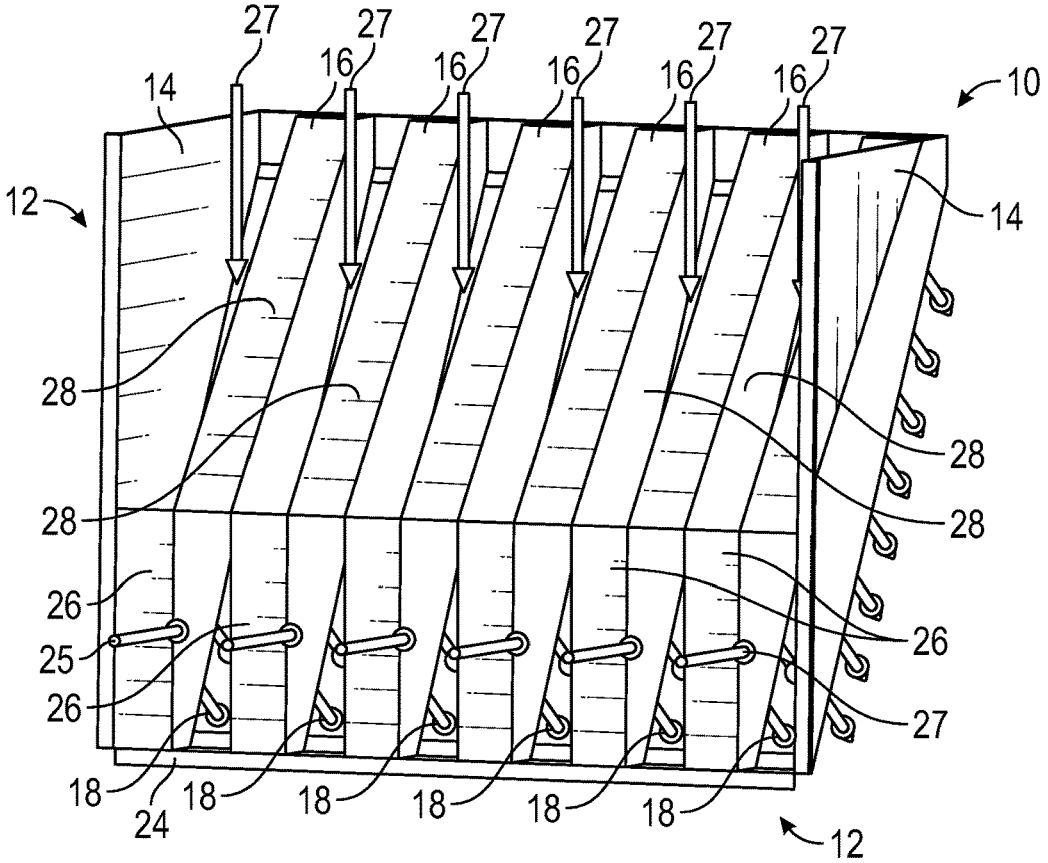
FIG. 2 is an upstream or rear view of the device of the invention in a first embodiment.
Figure 3:
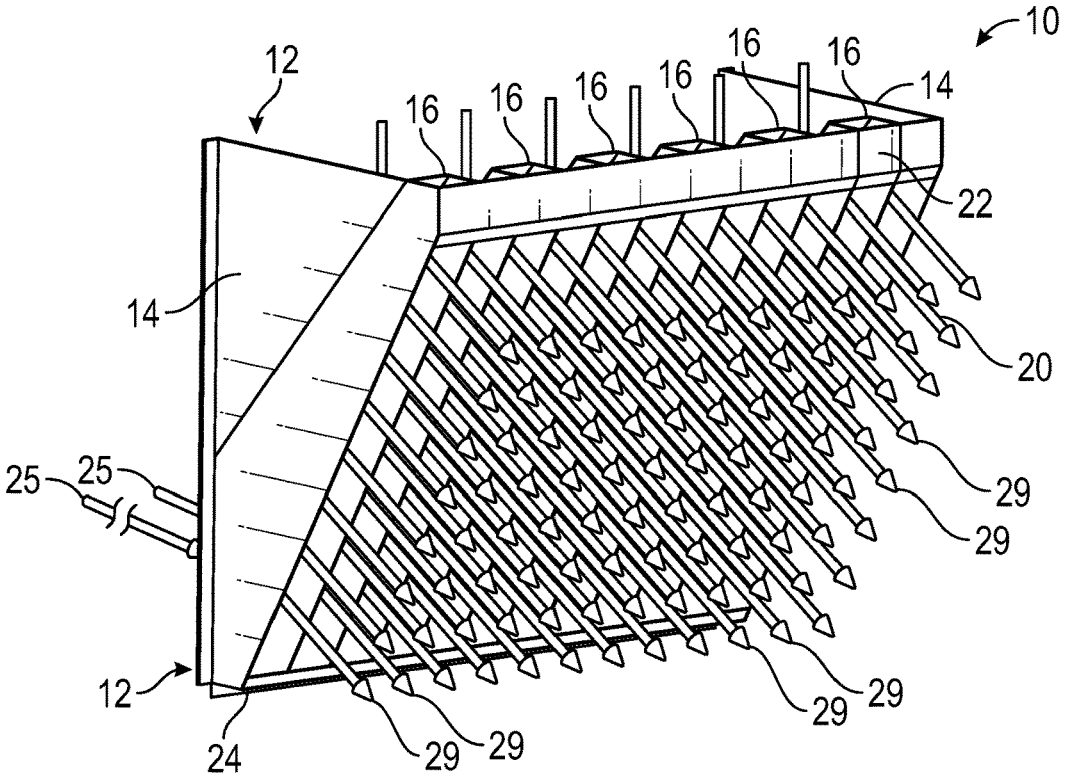
FIG. 3 is a downstream or front perspective view of the device of FIG. 2.

Referring specifically to FIG. 2, the upstream or backside of the device 10 shows that the ribs 16 have a changing cross-sectional shape as the ribs extend vertically. At the upper and lower ends of the ribs, the ribs each have smaller cross sections, but as the ribs progress towards the center area of the ribs, their cross-sectional shapes become larger, and a shape transition 36 defines an area on the ribs in which there is a directional change between the upstream surfaces or edges of the ribs 16. The upstream surfaces/edges in FIG. 2 are denoted by lower upstream portions 26 that extend vertically, and the remaining portions 28 extend upwardly at an angle. The particular selected geometric configurations for the upstream surfaces/edges of the ribs accommodate airflow directions as shown with the directional arrows. More specifically, the particular selected shape, size, and angular orientation of the upstream surfaces will generally dictate how the airstream at that location flows through the device. In the example of FIG. 2, the horizontal airflow originates from a connected duct which may have a geometric area that generally matches the area encompassed by the lower upstream portions 26, while the vertical airflow originates from a connected duct which may have an area that generally matches the area encompassed by the remaining portions 28. In this regard, each duct may have its own distinct cross sectional area and angle of approach that communicates with the device 10. Accordingly, when the two airstreams reach the device, airflow is directed between the ribs 16 and into the respective channels 18. Further, while FIG. 2 illustrates the upstream surfaces/edges as being generally flat and perpendicular to the incoming airstreams, is also contemplated that these upstream surfaces/edges could be tapered upstream in a curved configuration, or could have other selected shapes that would most effectively result in mixing of the airstreams.

Figure 4:
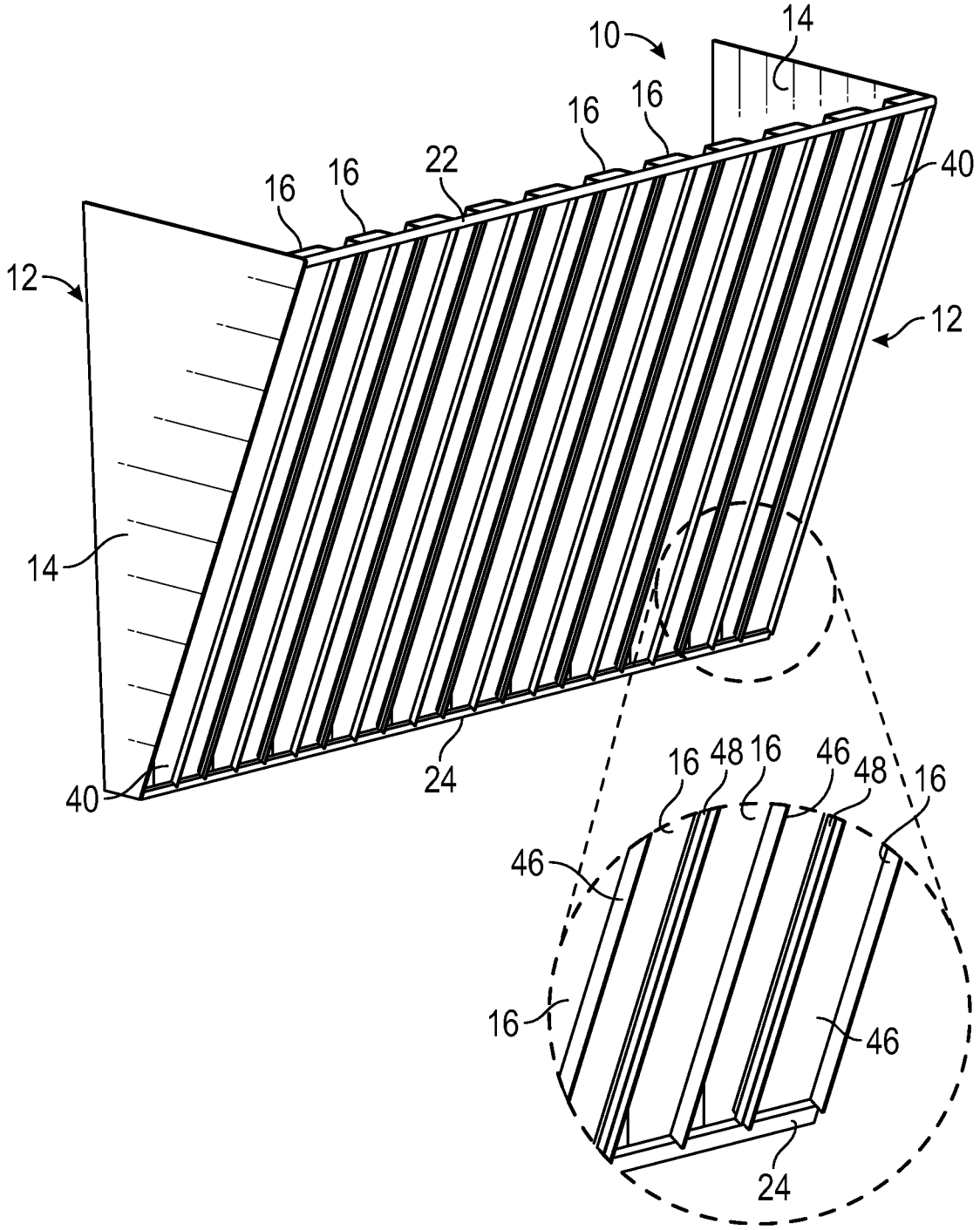
FIG. 4 is a simplified view of FIG. 3, along with an enlarged portion to further illustrate structural details to include a plurality of seals that can be used to seal an overlying cover plate.
Figure 5:
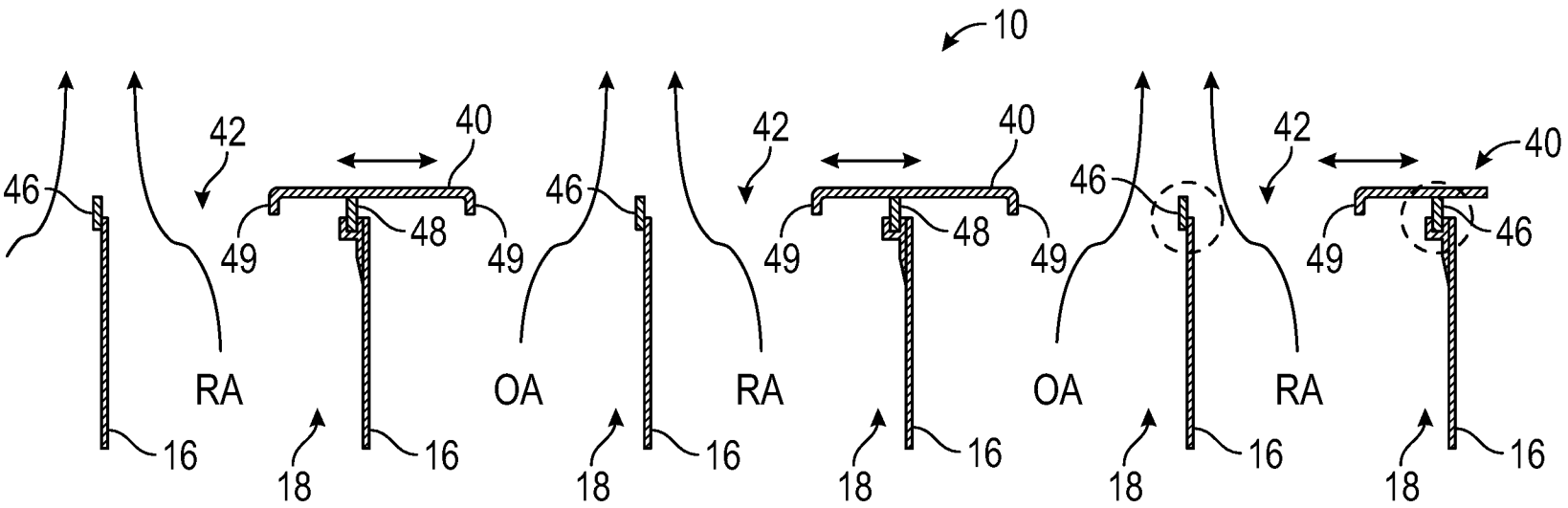
FIG. 5 is an enlarged fragmentary horizontal section of the device illustrating how a cover plate of the device may be controlled or actuated to modify the airflow through the device.
Figure 6:
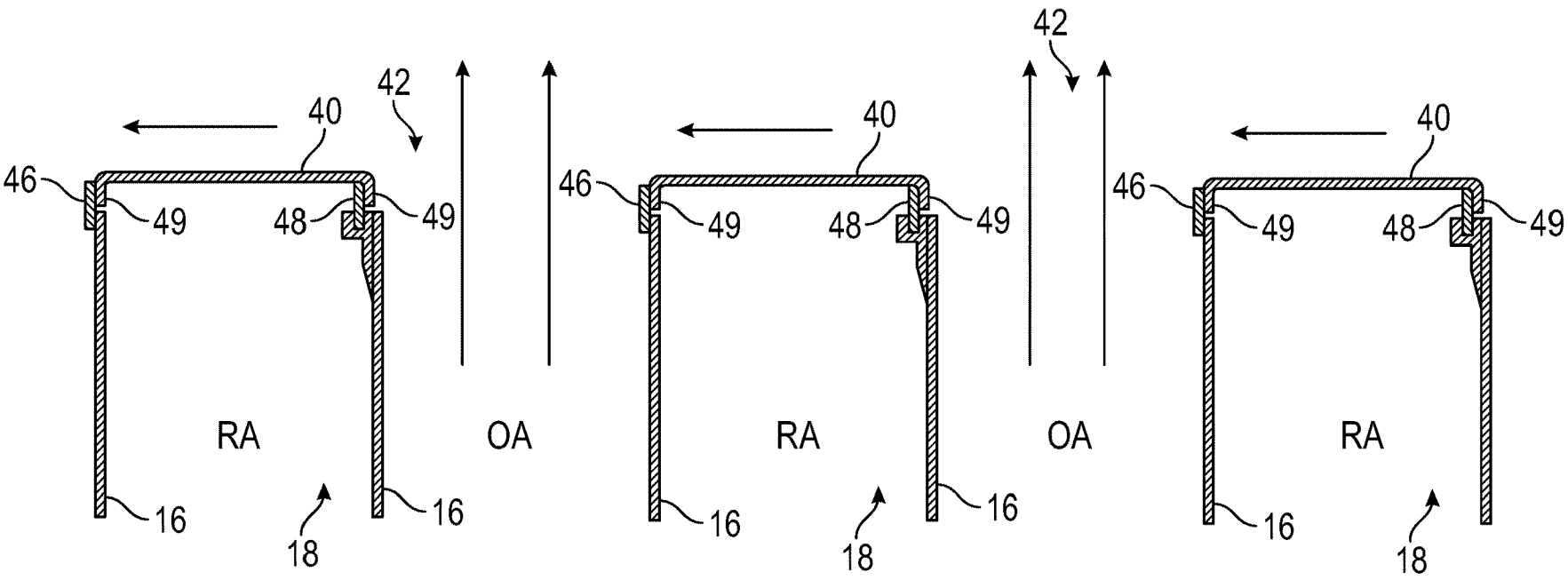
FIG. 6 is another enlarged fragmentary horizontal section illustrating how the cover plate is controlled to modify airflow.
Figure 7:
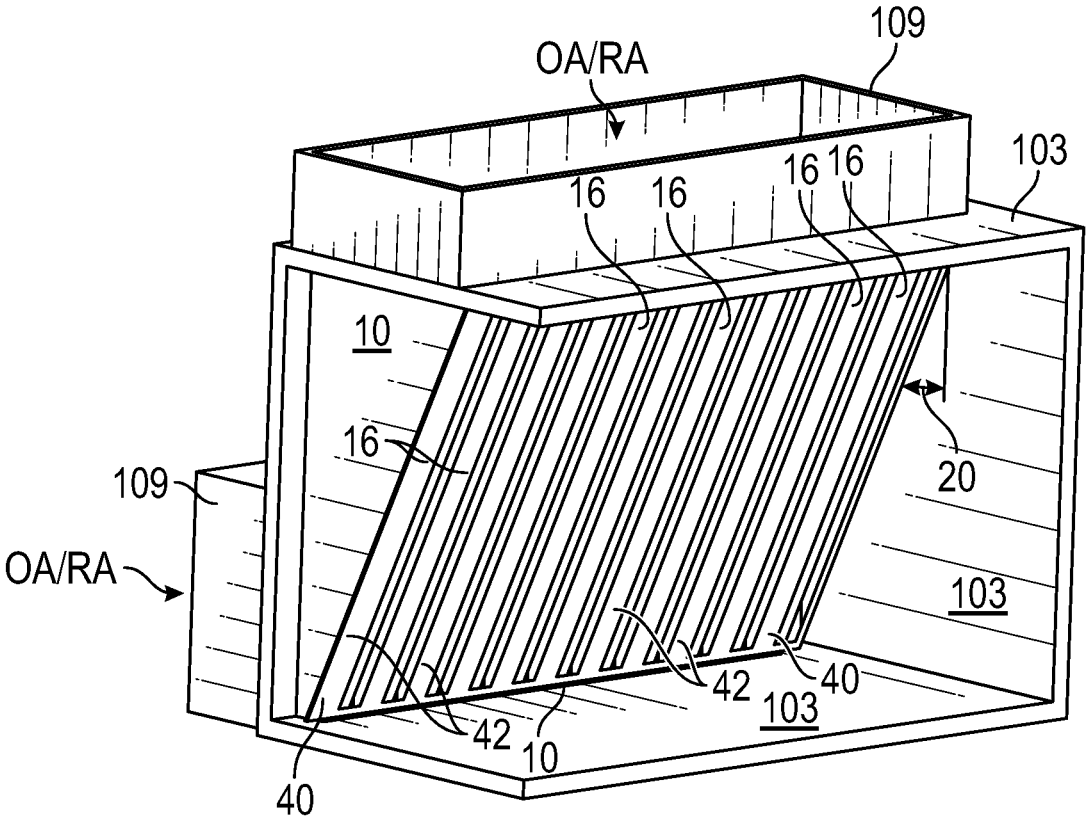
FIG. 7 is a perspective view of the device as mounted within the economizer portion or section of the mixing box, or other portion of an air handling unit which receives return air and outdoor air.
Figure 15:
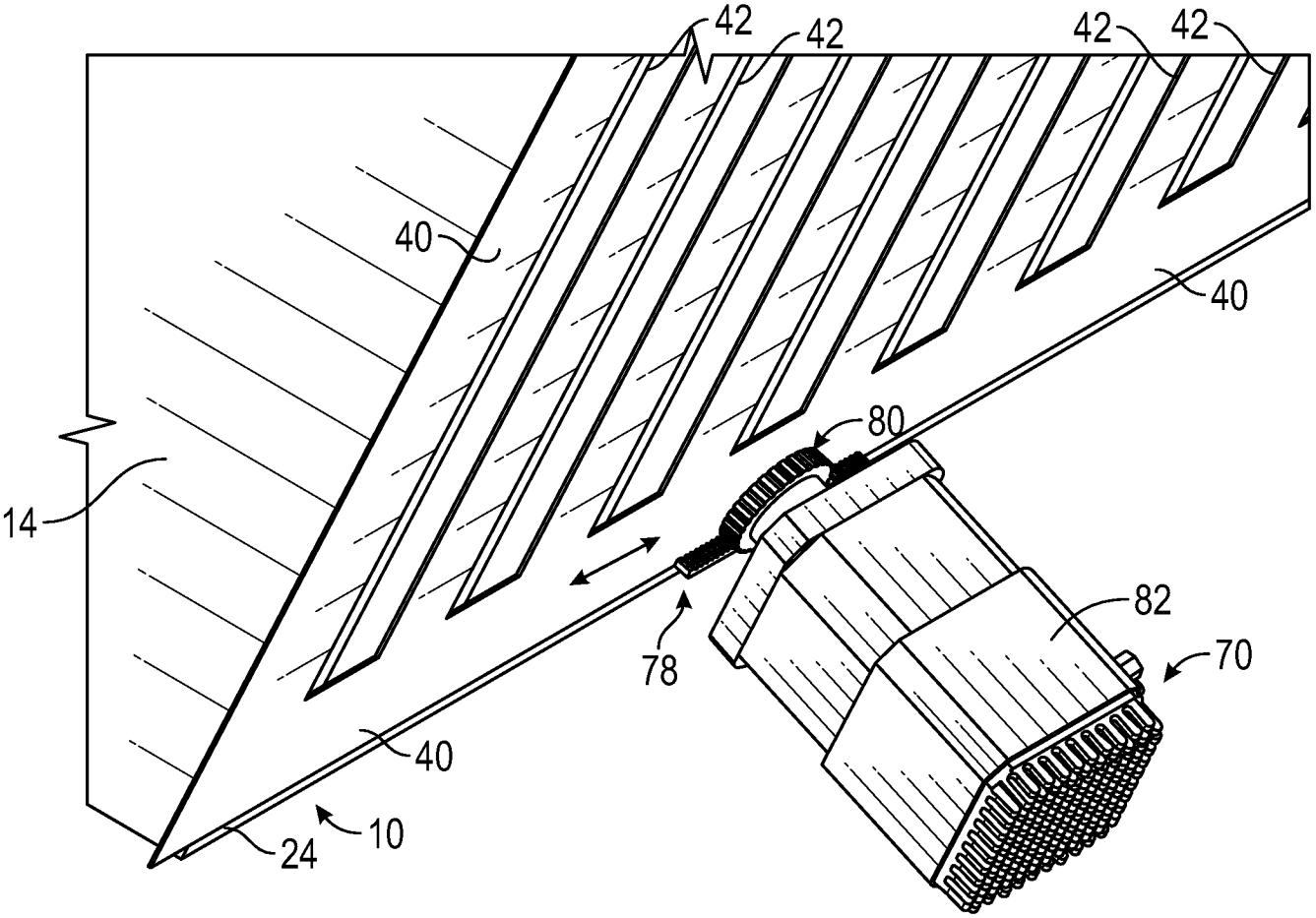
FIG. 15 illustrates one type of control element that may be used to control the positioning of the cover plate.
Figure 16:
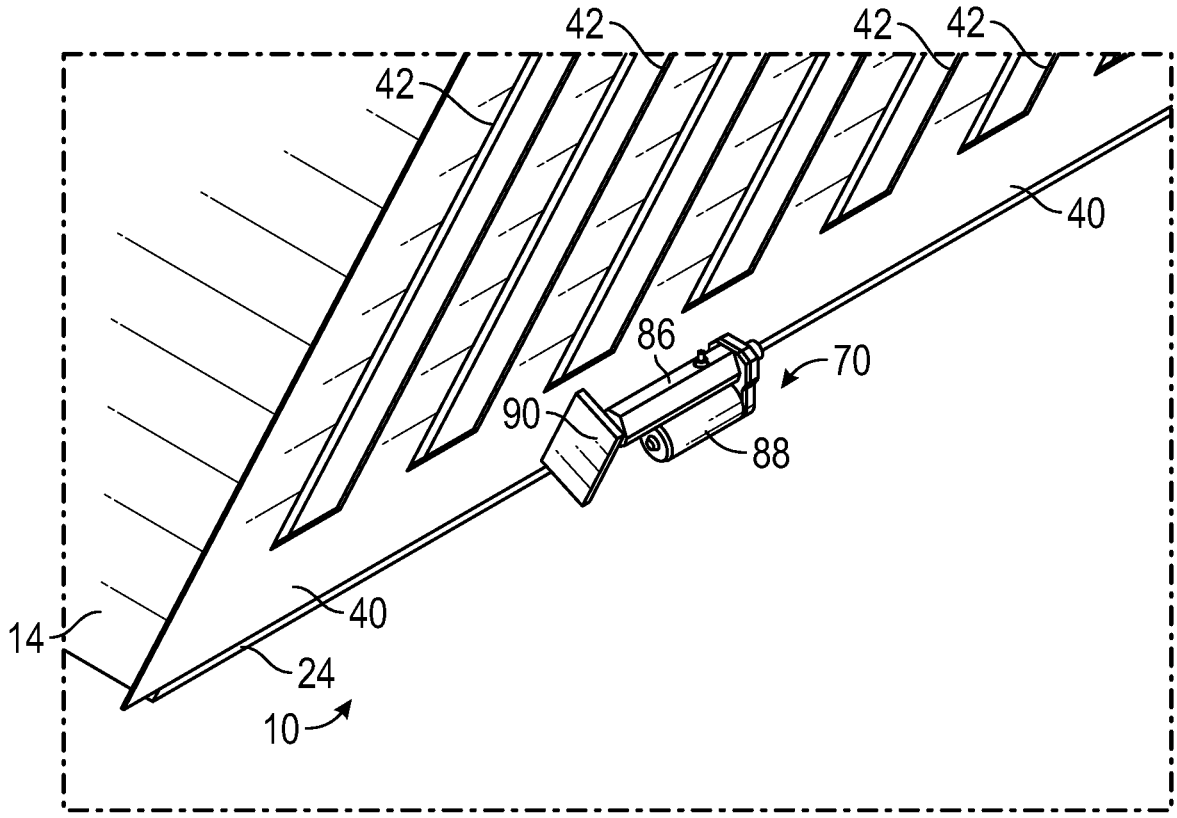
FIG. 16 illustrates another type of control element that may be used to control the positioning of the cover plate.

Referring to FIGS. 4, 5-7, and 11 additional structure is shown for the device 10 which includes a cover plate 40 and a plurality of seals that can be used to seal the cover plate with respect to the ribs 16 or downstream surfaces of the housing 12. Referring first to FIGS. 5-7 and 11, the cover plate 40 is attached to a downstream side or surface of the housing 12, and the cover plate is selectively and controllably shifted or indexed to control the volume of air that flows through the device, and to also control the particular portions of the airstreams which flow through the device. FIGS. 5 and 6 provide specific examples of how the cover plate 40 may be selectively shifted or indexed to control the volume of air allowed to pass from each separate airstream. Structurally, the cover plate 40 has a plurality of slots 42, and the width and length of the slots can be modified in order to selectively alter the locations and volumes of air which pass through the device. In FIG. 5, one exemplary position of the cover plate 40 is shown in which gaps are provided between adjacent channels such that both return air RA and outdoor air OA may pass through the device. FIG. 5 also illustrates the way the cover plate communicates with the front face of the device such that airflow is sufficiently controlled to prevent air passage inadvertently around edges of the cover plate or between other locations where there may be gaps between the cover plate and device. Referring also to FIG. 4, two sets of seals are shown to ensure air passes as intended. Specifically, a first set of seals or wipers 46 are provided, along with a second set of seals or brushes 48. Also referencing FIG. 6, it can be seen how positioning of the cover plate between two different positions effects airflow. In FIG. 5, both return air RA and outside air OA are allowed to pass. In FIG. 6, the cover plate has been shifted to the left such that the return air RA is blocked and only outside air is allowed to pass. The wiper seals 46 abut one edge of the cover plate openings, while the second seals abut the opposite edge of the cover plate openings. In order to provide a greater surface area for the seals 46 and 48 to contact and achieve sealing engagement, the cover plate may have bends or lips 49 which enables the cover plate to make flush contact with the seals 46 and 48 as shown. These bends 49 also provide additional stiffening strength to the cover plate. FIGS. 15 and 16 discuss examples of power means provided by which the cover plate can be selectively and controllably shifted.

Although not shown in FIGS. 5 and 6, it should be understood that the cover plate can be shifted to the right such that the flow of outside air OA is blocked, while the flow of return air RA is allowed to pass. It should also be appreciated that there are nearly an infinite number positions in which the cover plate can be moved between two extreme positions; that is, between a first position in which return air RA is blocked, and a second position in which outdoor air OA is blocked.

Also referring again to FIG. 7, this figures shows how the device 10 may be mounted within the economizer portion of a mixing box 103. The return air RA and outdoor air OA are two flow components that communicate with the device, and it should be understood that the ducts 109 connecting to the device 10 can receive the respective airstreams in which return air RA or outdoor air RA are received through either duct. As also shown, the upstream or rear side of the device 10 can be mounted flush to the vertical wall of the mixing box 103, while the upper surface of the device can be mounted flush with the upper horizontal wall of the mixing box. Sizing of the device in this way ensures that there are no components of the incoming airstreams that do not pass through the device. Some angularity is provided for the positioning of the ribs 16, thereby resulting in a resulting airflow downstream that may be directionally controlled, as discussed with respect to a desired selected angle 20.

Figure 8:
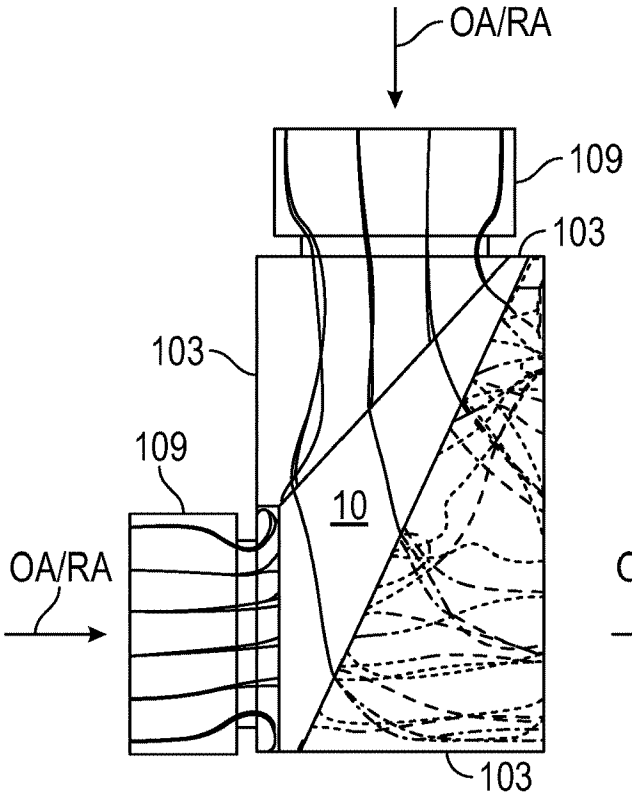
FIG. 8 is a vertical cross-section of the device as mounted showing outdoor air and return air streams as they would normally pass through the mixing device.

Referring to FIG. 8, this illustration provides a visual display from a computational fluid dynamic model of how two airstreams may generally react as they enter a mixing box 103 of an air handling unit. One airstream may be represented by the horizontal flow of air, while the other airstream may be represented by the vertical flow of air. In this figure, the horizontal airstream is blocked, while the vertical airstream is allowed to pass. This particular pattern of airflow can be represented, for example, in FIG. 6 with reference to the specific positioning of the cover plate to block return air RA and allow passage of outside air OA. This figure is intended to further illustrate how the vertical airstream passes through the device, and the airstream changes direction and becomes a turbulent mixed flow as it passes downstream beyond the device.

Figure 9:
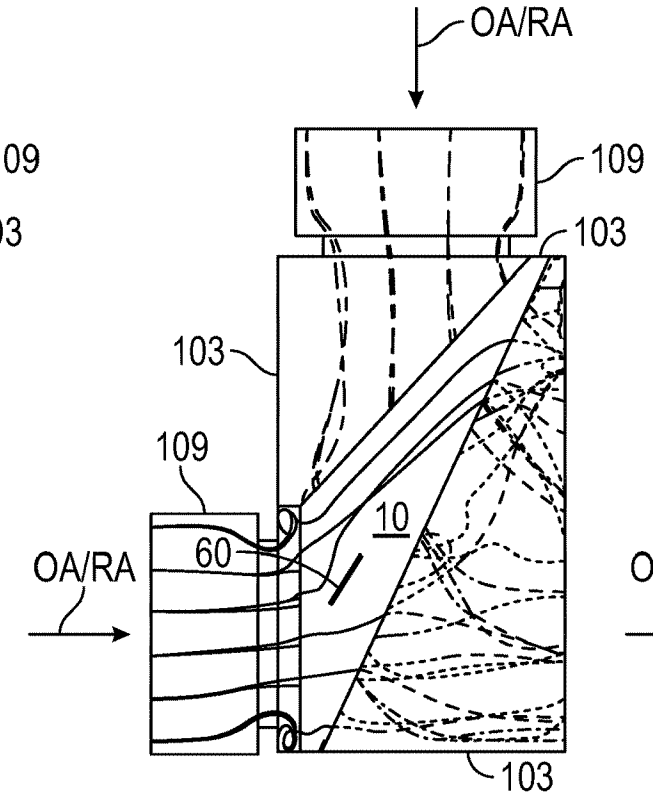
FIG. 9 is a vertical cross-section of the device further including a turning vane added to the device in order to manipulate airflow.

Referring to FIG. 9, this illustration provides another visual display from a computational fluid dynamic model of the two airstreams, but the device is modified to include a turning vane 60 to alter the directional flow of the airstreams. The specific structure of various types of vanes that can be incorporated in the device is discussed below in more detail with reference to FIGS. 17 and 18. The cross sectional view of FIG. 9 only illustrates one vane, but any number of vanes can be added to selected channels to precisely control directional airflow through the device. The vane 60 in this figure shows that it is capable of altering the directional flow of the horizontal airstream such that it substantially raises the elevation of the portion of the airstream located at or above the vane 60. Conversely, if the vane was oriented at an opposite angle, the vane would be capable of altering the directional flow of the airstream so that it substantially lowered the elevation of the portion of the airstream located at or below the vane 60. One primary purpose of the vanes is to force a directional change of the airflow and to therefore change the momentum of a selected airstream with the intent of increasing mixing effectiveness within the mixing box. In the example of FIG. 9, if no vane was used, then the momentum of the horizontal airstream might continue along the bottom portion of the mixing box; accordingly, there would not be effective mixing of the two airstreams. Since both airstreams are passed through the device in FIG. 9, this configuration might correspond to what is illustrated in the example of FIG. 5 in which both return air RA and outside air OA are allowed to pass because positioning of the cover plate does not completely block either airstream. It should be apparent that extremely varied mixing profiles can be created to selectively mix return air and outdoor airstreams by inclusion of turning vanes. It should also be understood that the particular angles of the turning vanes can be altered to maximize directional control of the airflow.

Figure 10:
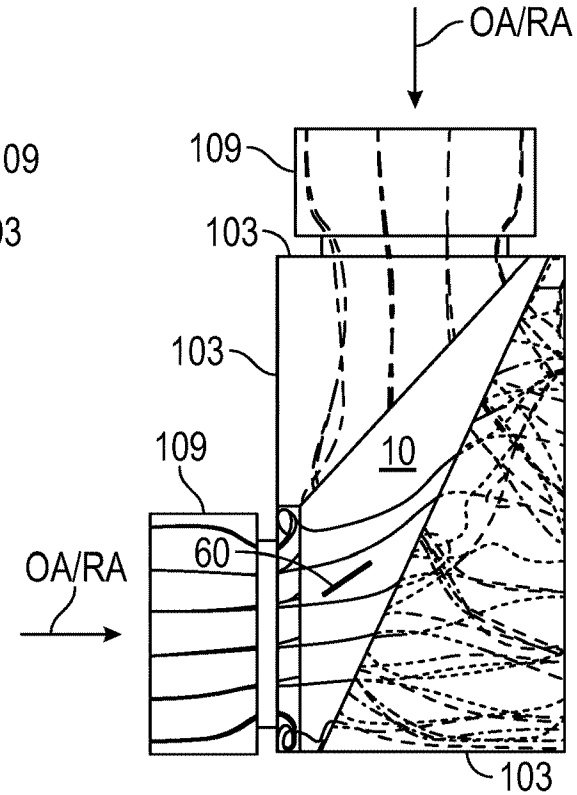
FIG. 10 is another vertical cross section of the device showing the turning vane adjusted at a different angle to further manipulate airflow.

Referring to FIG. 10, this illustration provides yet another visual display from a computational fluid dynamic model of the two airstreams, but the turning vane 60 is provided at a different angle; that is, if measured from the vertical, a smaller angle in which the directional flow of the horizontal airstream is still raised in elevation, but not to the extent as compared to the resulting flow shown in FIG. 9. This figure is therefore intended to represent how a particular selected angle for the vanes 60 may be used to alter the downstream flow to generate desired mixing and turbulence. In both FIGS. 9 and 10, these can be interpreted as also representing only allowing a horizontal flow of air to pass and blocking vertical flow. Again, this could correspond to what is illustrated in FIG. 6 in which outside air is allowed to pass while return air is blocked or outside air is blocked and return air is allowed to pass (if the cover plate was shifted to the right in FIG. 6). By a review of FIGS. 8-10, it should be apparent that the device of the invention can provide a wide range of control for at least two separate airstreams which enter a mixing box of an air handling unit.

Figure 11:
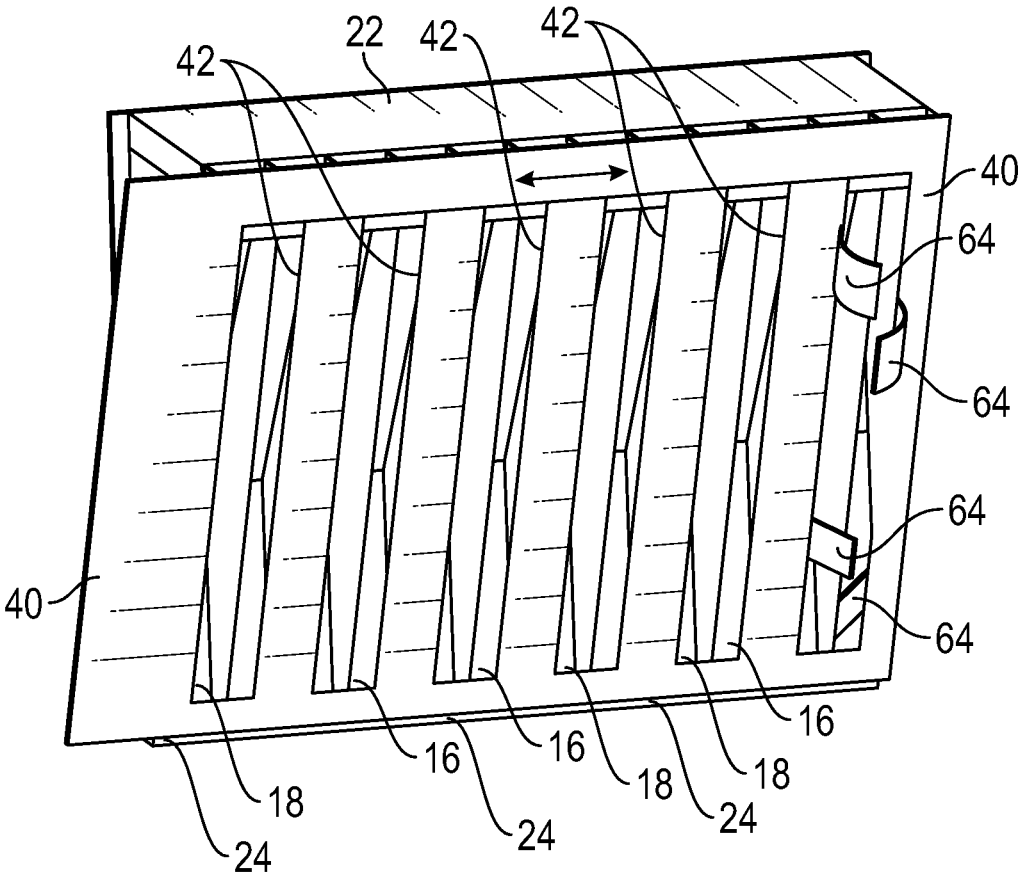
FIG. 11 is a simplified perspective view of the device further illustrating downstream blades attached to the cover plate.

Referring to FIG. 11, an additional modification is illustrated for the cover plate 40 which includes mixing blades 64 that extend downstream. These mixing blades are mounted as shown to the cover plate so that they can provide further mixing of the airstreams. Mixing blades 64 can be added to any one or all of the slot openings, and can be sized and spaced to maximize desired additional mixing. Further, the particular shape of the blades can be selected to effect desired mixing, and FIG. 12 represents but two exemplary shapes: curved and planar.

Figure 12:
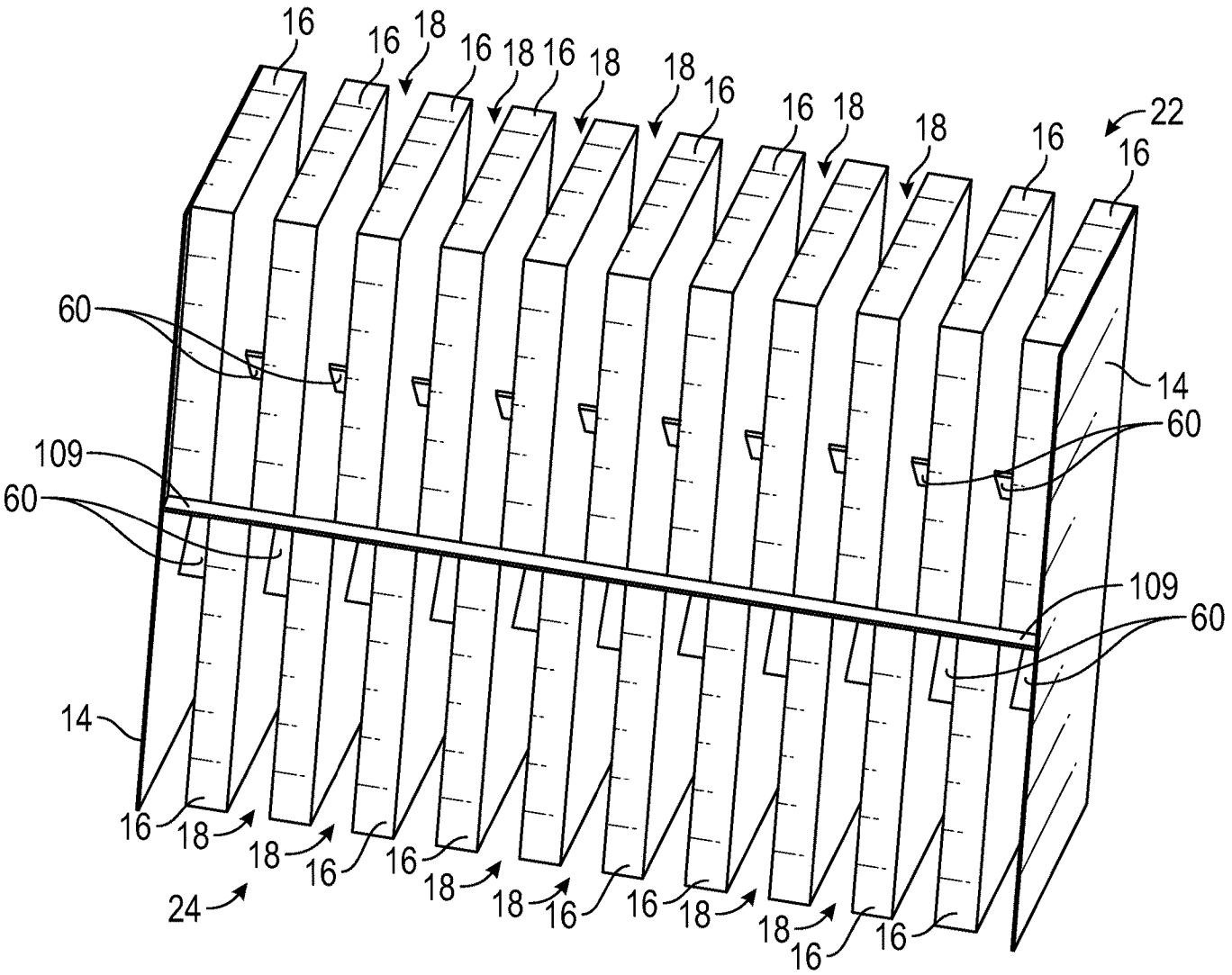
FIG. 12 provide one example of a rib configuration in order to receive and control both return air and outdoor air based upon the particular angles at which the return air and outdoor air ducts communicate with the device.
Figure 13:
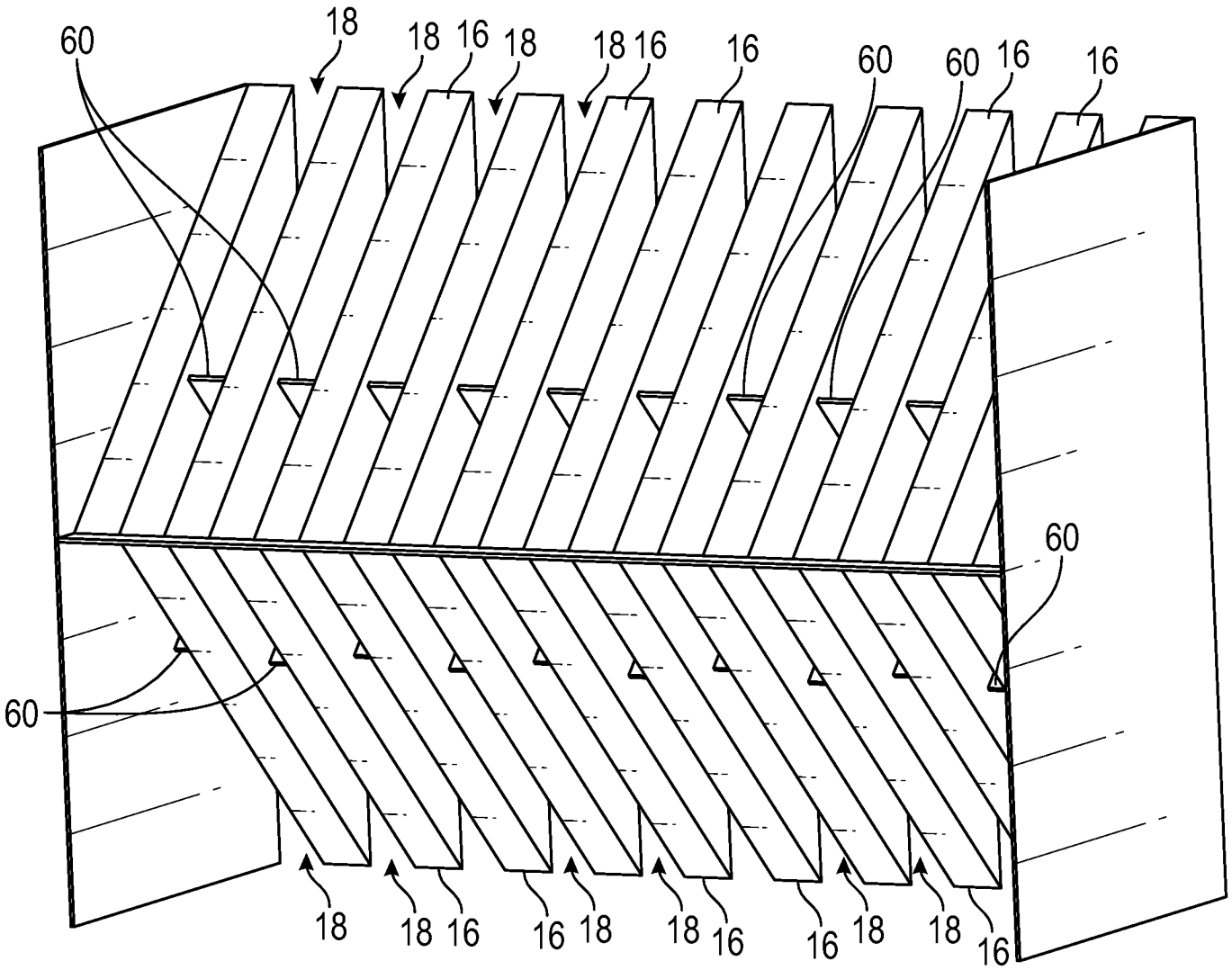
FIG. 13 provides another example of a rib configuration in order to maximize control both return air and outdoor air based upon different angles at which the return air and outdoor air ducts communicate with the device.
Figure 14:
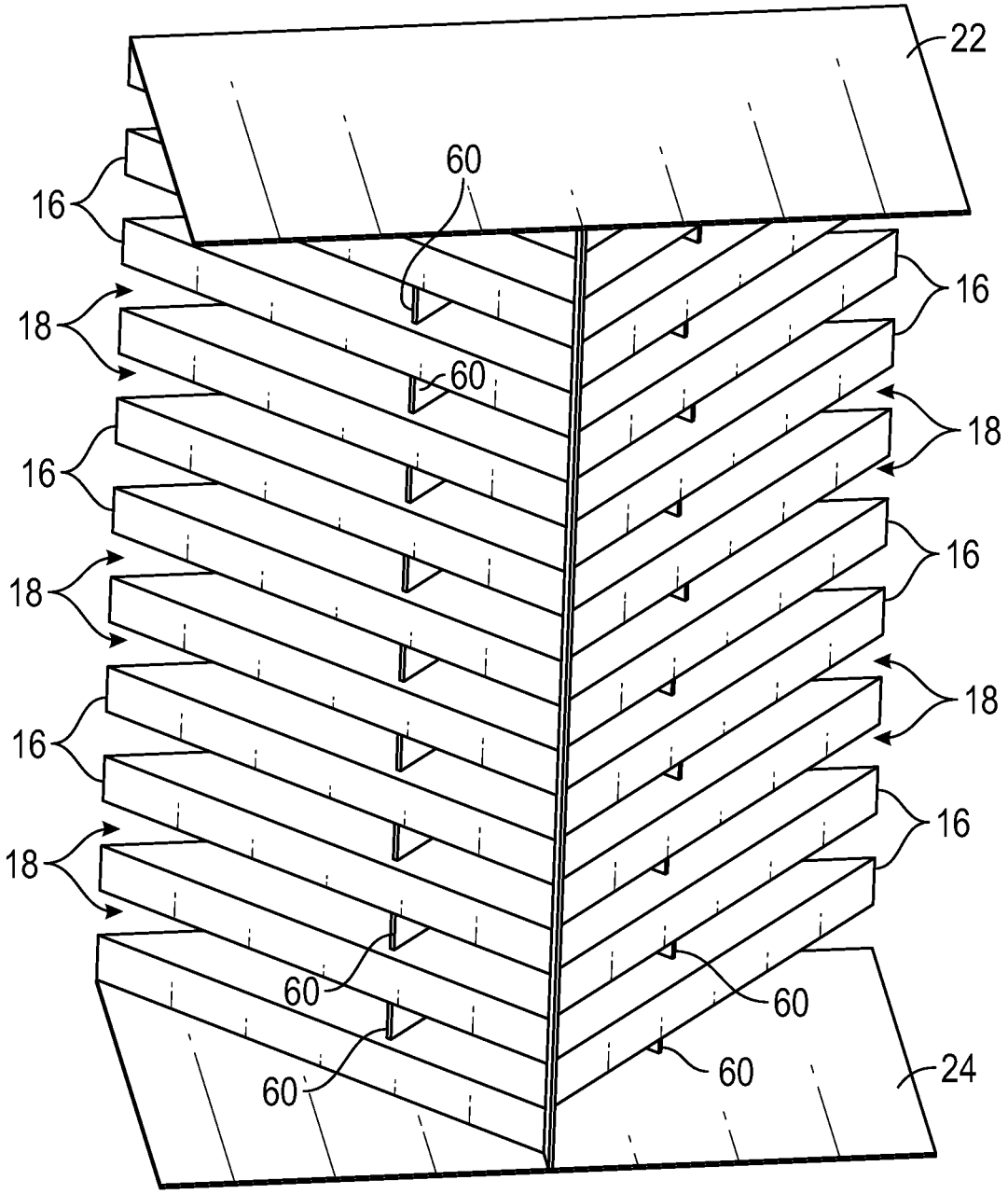
FIG. 14 illustrates a similar configuration as FIG. 13, but confirming that the device may be rotated in order to maximize control, again based upon the particular angles at which the return air and outdoor air ducts communicate with the device.

Referring to FIGS. 12-14, additional exemplary configurations are shown for the upstream or inlet sides of the device 10. The cover plate 40 is not illustrated to simplify these drawings and to better illustrate the positioning of the ribs 16. For any of these embodiments, the incoming air from each inlet can be received from two different directions. For the top or upper surfaces of the ribs 16, airflow can be received from the top or back of the mixing box while for the bottom inlet, airflow can be received from the bottom or back of the mixing box. The separation between the flows of air for respective ducts carrying the separate flows of air is generally designated by the duct 109 which separates the inlet to the device into upper and lower portions according to the orientation of this figure. As shown, the ribs 16 corresponding to these upper and lower portions are offset or staggered from one another, allowing the cover plate 40 to be selectively shifted to control flow as described in reference to FIGS. 5 and 6. That is, fully shifting the cover plate to one side will block flow from one airflow source, fully shifting the cover plate to the other opposite side will block flow from the other airflow source, and a number of infinite positions are provided between these two extreme positions to allow airflow to pass from both airflow sources in desired incremental amounts/volumes for each.

FIGS. 12-14 also show respective turning vanes 60 that may be incorporated in the device, in which each incoming airstream may have its own distinct set of turning vanes 60 in order to alter its flow through the device.

FIG. 14 is more specifically provided to show that the device can be rotated at any particular angle, such as 90°, to accommodate incoming air ducts that may be connected to the mixing box at any one of various angles. Therefore, this example, the incoming ducts would be disposed substantially horizontal and separated from one another by approximately 90° as measured from a horizontal angle. It should be appreciated by a review of this figure as to the adaptable construction of the invention to handle a nearly limitless combination of ductwork configurations. It should also be understood with this figure that the cover plate would shift or translate vertically in order to accommodate desired air flows through the device.

Referring to FIG. 15, the cover plate can be actuated by a control element 70, such as a rack and piston actuator as shown. More specifically, a rack 78 can be mounted to the front or downstream surface of the cover plate 40, and a pinion 80 can be positioned to engage the rack 78 to affect shifting or translation of the cover plate with respect to the stationary housing of the device 10. A motor 82 could be mounted to the air handling unit (not shown) in which the motor 82 rotates the pinion 80, which in turn, causes linear movement of the rack 78 and cover plate 40. Depending upon the size of the device, multiple actuators 70 may be provided to effectively and smoothly shift the cover plate without binding or bending of the cover plate. For example, one or more actuators could be mounted to both the upper portion and lower portion of the cover plate. Each of the motors can be synchronized so that even and consistent driving power is transferred from the pinions 80 to the corresponding racks 78.

Referring to FIG. 16, another example of an actuator 70 is shown in the form of a linear actuator; a piston 86 driven by a motor 88. A drive plate 90 is secured to the downstream surface of the cover plate 40. A piston rod (not shown) of the piston 86 has a distal or free end that connects to the drive plate 90. The piston rod can be selectively extended or retracted by power from the motor 88 thereby affecting linear shifting movement of the cover plate 40. As with the previously discussed actuator of FIG. 16, the actuator of FIG. 17 may be provided in multiples so that enough power is provided to smoothly shift the positioning of the cover plate without binding.

Figure 17:
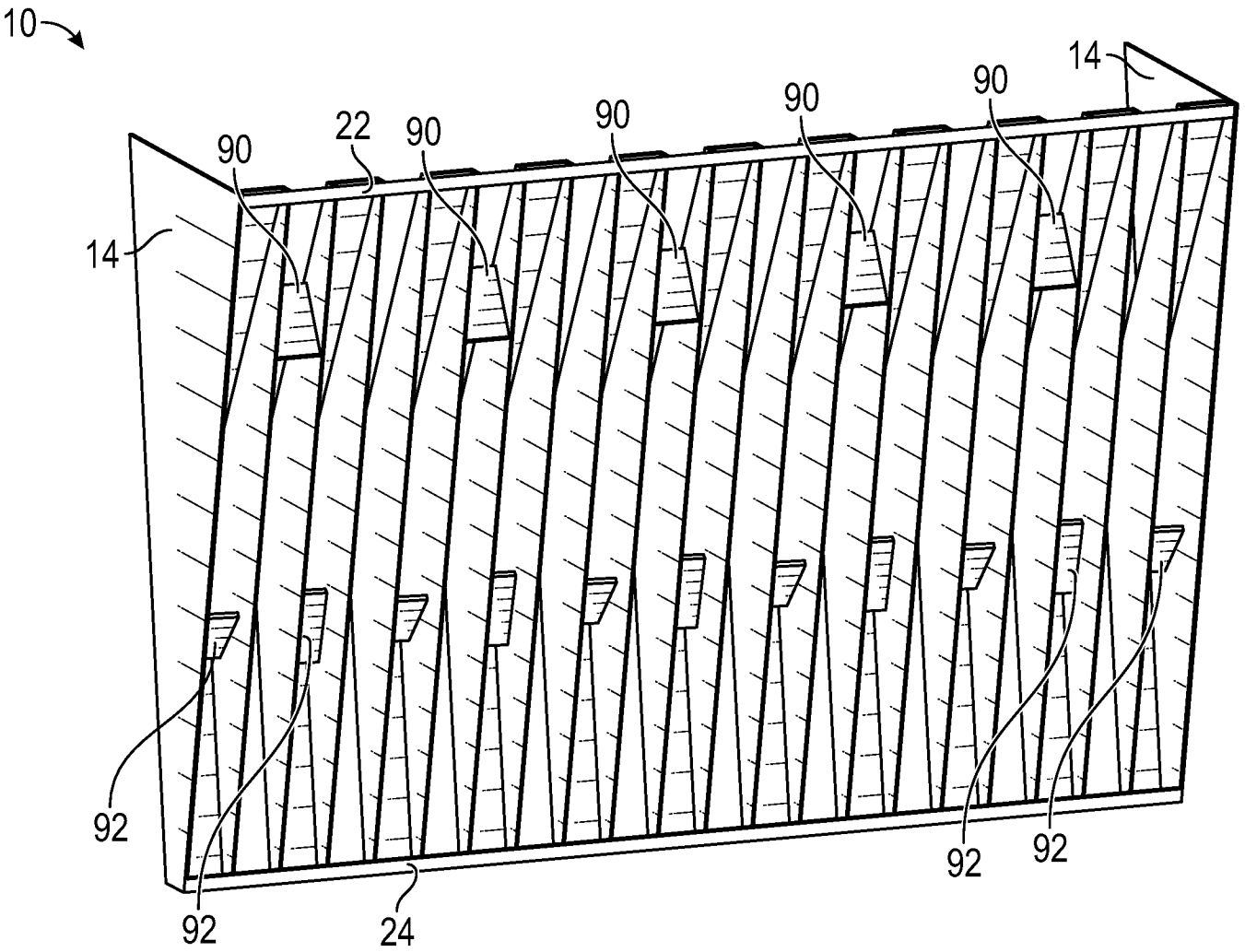
FIG. 17 is a downstream or front perspective view of the device showing one example configuration of the turning vanes.
Figure 18:
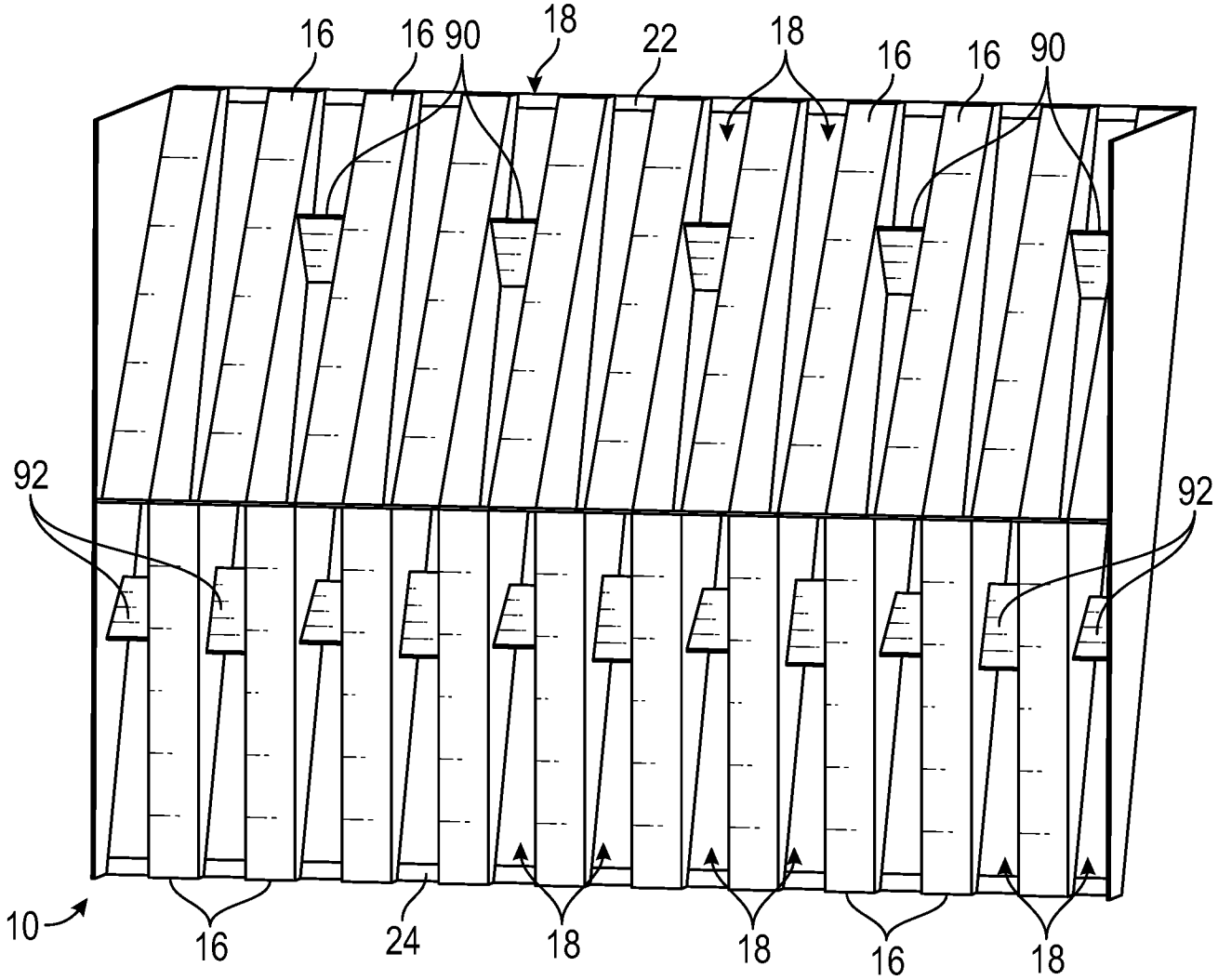
FIG. 18 is an upstream or rear perspective view of the device showing the example configuration of the turning vanes.

Referring to FIGS. 17 and 18, simplified perspective views of the device 10 are illustrated showing in better detail how a plurality of turning vanes 60 can be incorporated within the device. The cover plate 40 is again removed to better illustrate the vanes 60. Each gap or channel 18 located between pairs of ribs can be identified as corresponding to air which originates from an airstream. The vanes are mounted to extend across a selected channel 18 and each vane within each channel can be angled to best affect the directional airflow to be achieved for air passing through that channel. In the example of FIG. 18, a first set of turning vanes 90 are disposed toward the upper end of the device and have a consistent angle. This first set is provided to directionally control airflow originating from an air duct communicating with the upper portion of the device. A second set of vanes 92 are provided to directionally control airflow originating from an air duct communicating with the lower portion of the device. The second set of vanes 92 does not have consistent angles but rather there is an alternating arrangement selected for this set of vanes in which the vanes alternate with two separate and distinct angular orientations. It should therefore be understood that numerous sets of vanes can be provided, at desired locations, and with desired shapes and angles.

Figure 19:
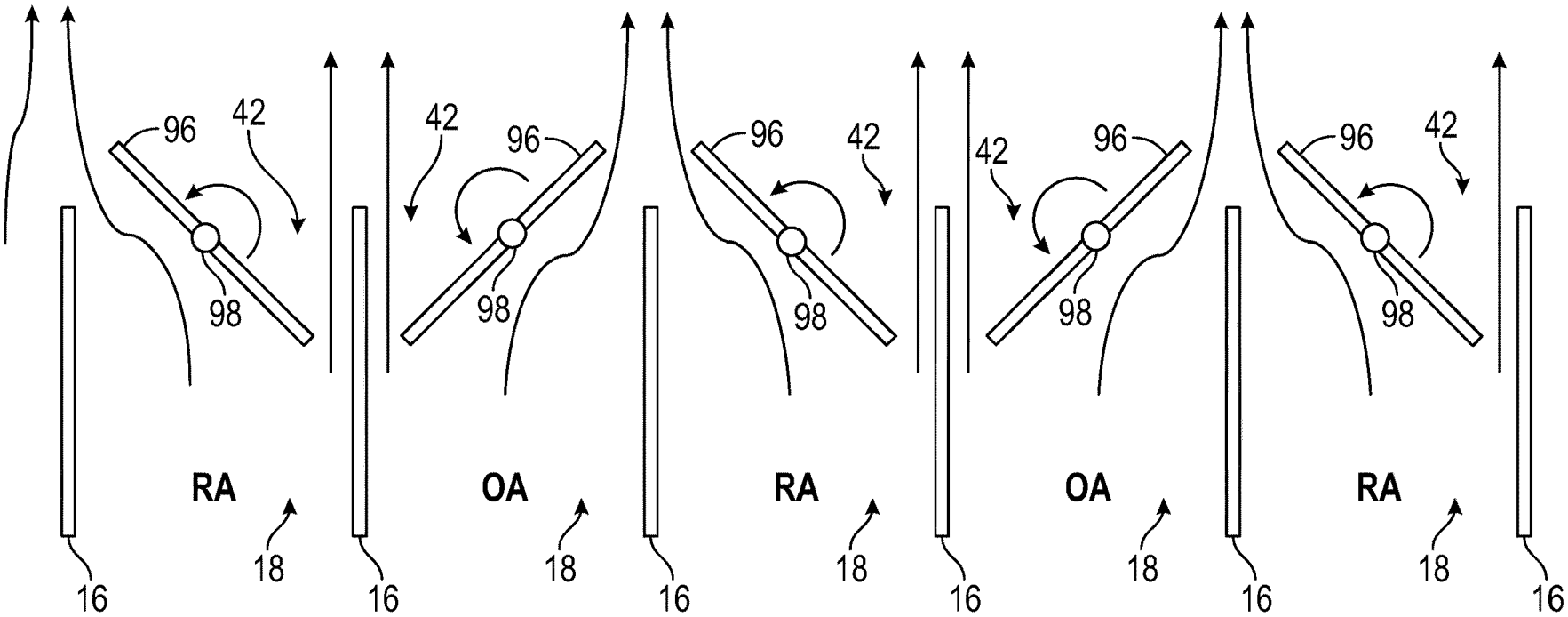
FIG. 19 is an enlarged fragmentary horizontal section of the device illustrating how a damper control function may be used in lieu of a cover plate to selectively controlled to adjust or modify airflow through the device.
Figure 20:
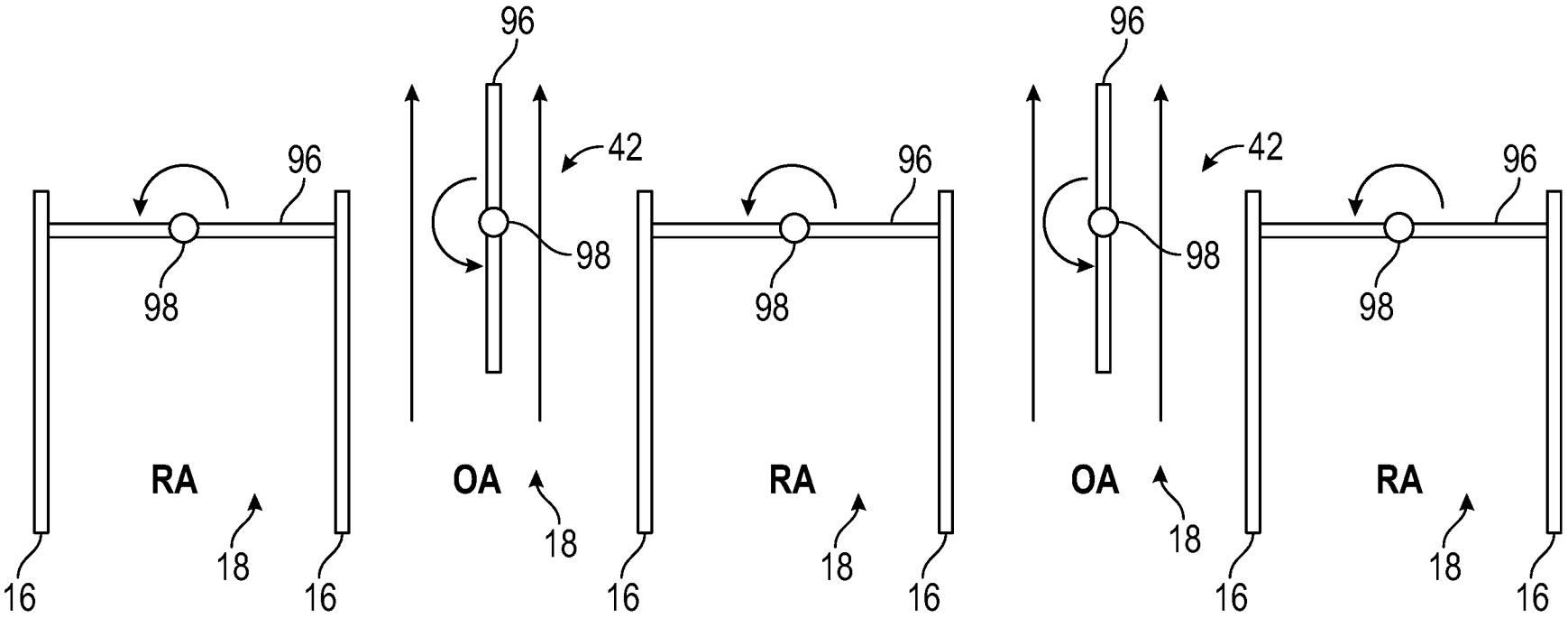
FIG. 20 is another enlarged fragmentary horizontal section illustrating how the damper control function is selectively controlled to adjust or modify airflow.

Referring to FIGS. 19 and 20, another embodiment of the device of the invention is illustrated in which the cover plate is replaced with individual damper control elements 96 that are located in the gaps or spaces defining the channels 18 that communicate with the downstream slots 42. The slots 42 in this embodiment represent more specifically the downstream areas through which air has completely passed through the device, and the size and configuration of the slots 42 being determined by the specific positioning of the damper control elements 96.

The damper control elements 96 are illustrated as each being rotatable about a central axis or a central point. This central axis may structurally correspond to a rod 98 which extends substantially parallel to the downstream face or surface of the ribs 16. Each rod is supported or anchored at its upper and lower ends, such as being attached to the respective upper and lower surfaces or ends 22, 24 of the housing 12. In order to control positioning of the damper control elements, each damper control element can have its own actuator 70. Alternatively, selected damper control elements 96 could be connected to one another by linkages, such as a connected cable or chain, in which return air RA channels 18 could each be connected to one another and/or in which outdoor air OA channels 18 could be connected to one another. As shown specifically in FIG. 19, this figure provides an example in which both return air RA and outside air OA are allowed to pass according to a control scheme in which temperature and humidity for the respective air streams are measured to determine respective amounts of each airstream that should allow to be passed in order to optimize conditioned air to be provided by an air handling unit.

Referring to FIG. 20, the damper elements 96 are rotated to another desired position in which return air RA is blocked and outside air OA is allowed to pass. Therefore, this figure is simply representative of another position in which the damper elements 96 may be controlled to maximize a desired air handling function, such as an optimizer function. FIGS. 19 and 20 are simplified in that they do not also show seals 46 and 48; however, it should be understood that the same or similar types of sealing structure can be provided for the embodiment of FIGS. 19 and 20 to prevent inadvertent passage of air. Further, it shall be understood that the damper elements 96 could be rotated such that the return air RA could be allowed to pass, while the outside air OA was blocked.

According to yet another aspect or feature of the damper control elements, it is also contemplated that damper control elements within each channel 18 could comprise more than one damper member, such as a pair of damper members provided in a parallel configuration or in an angled configuration such that pairs of damper members could be selectively rotated or shifted in order to effectively block the channels, or to allow passage of air through precisely defined open areas.

Another feature of the invention that can be provided is use of an upstream filter bank (not shown), and this filter bank can be located in close proximity to or in contact with the upstream surface of the device.

Figure 21:
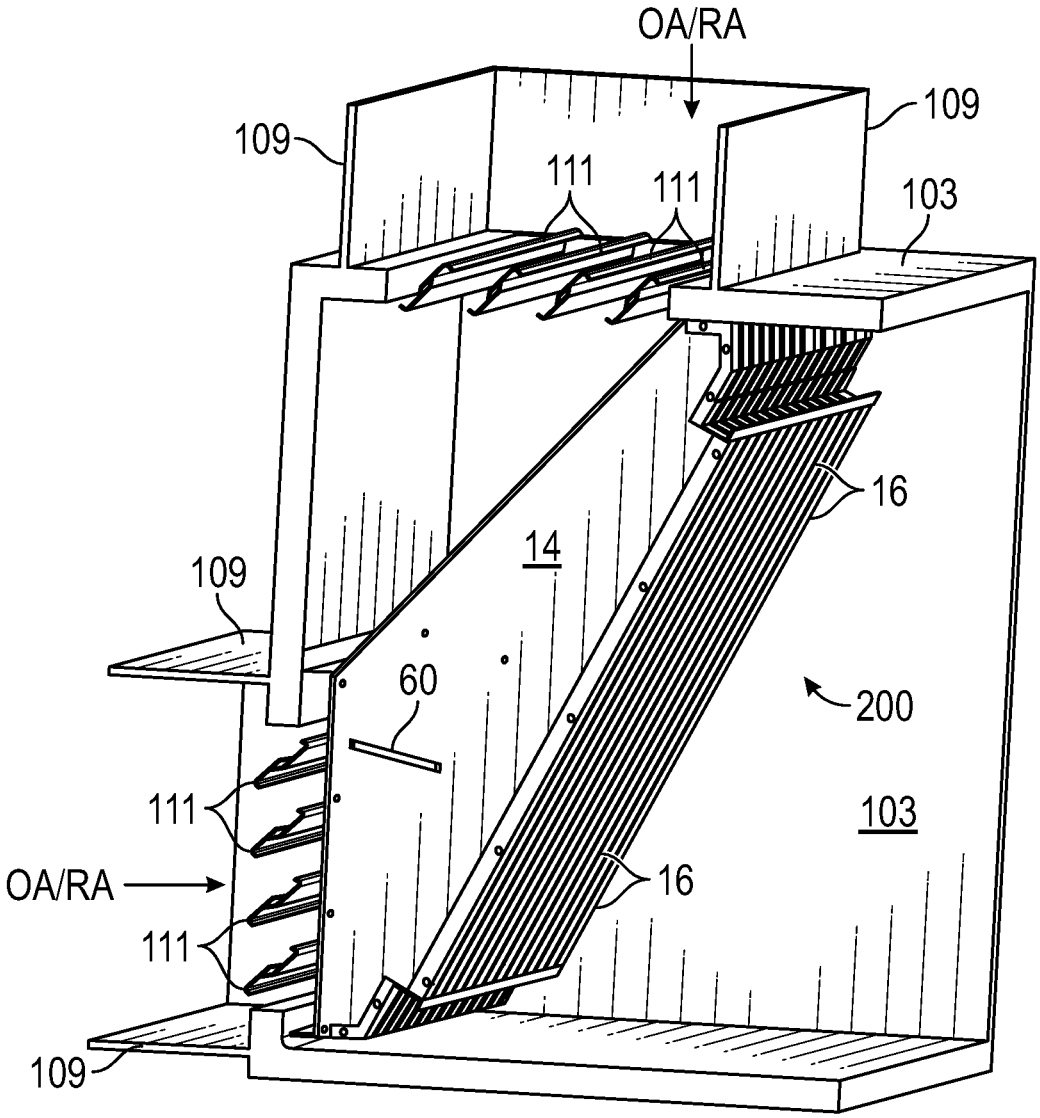
FIG. 21 is a perspective view of another embodiment of the device of the invention mounted within the economizer portion of a mixing box or other portion of an air handling unit which receives return air and outdoor air, and in which the existing dampers of the economizer remain installed.
Figure 22:
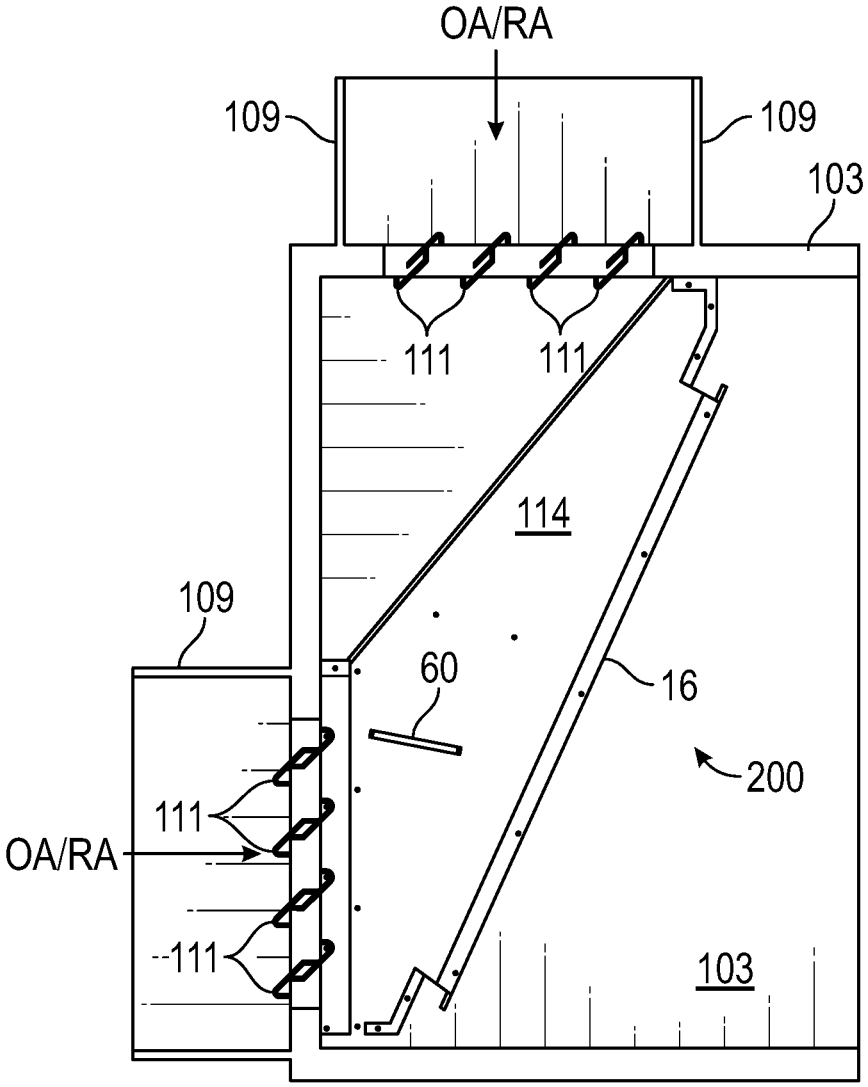
FIG. 22 is a vertical cross-section of the device of FIG. 21 as mounted showing the existing outdoor air and return air dampers installed.

FIGS. 21 and 22 illustrate another embodiment of the invention shown as mixing device 200. The primary distinction between the mixing device 200 of this embodiment and the prior embodiments is that this embodiment does not include a cover plate 40 nor control elements 72 actuate the control plate 40. This embodiment is especially adapted for mounting within a mixing box 103 in which the existing outside air and return air dampers 111 remain installed. Structurally, the mixing device 200 may be the same as the prior embodiments with the exception of no cover plate and no corresponding control elements. Accordingly, the mixing device 200 includes a plurality of spaced ribs 16 mounted within a housing 12, and may further incorporate turning vanes 60 to alter the directional flow of the selected airstreams.

Figure 23:
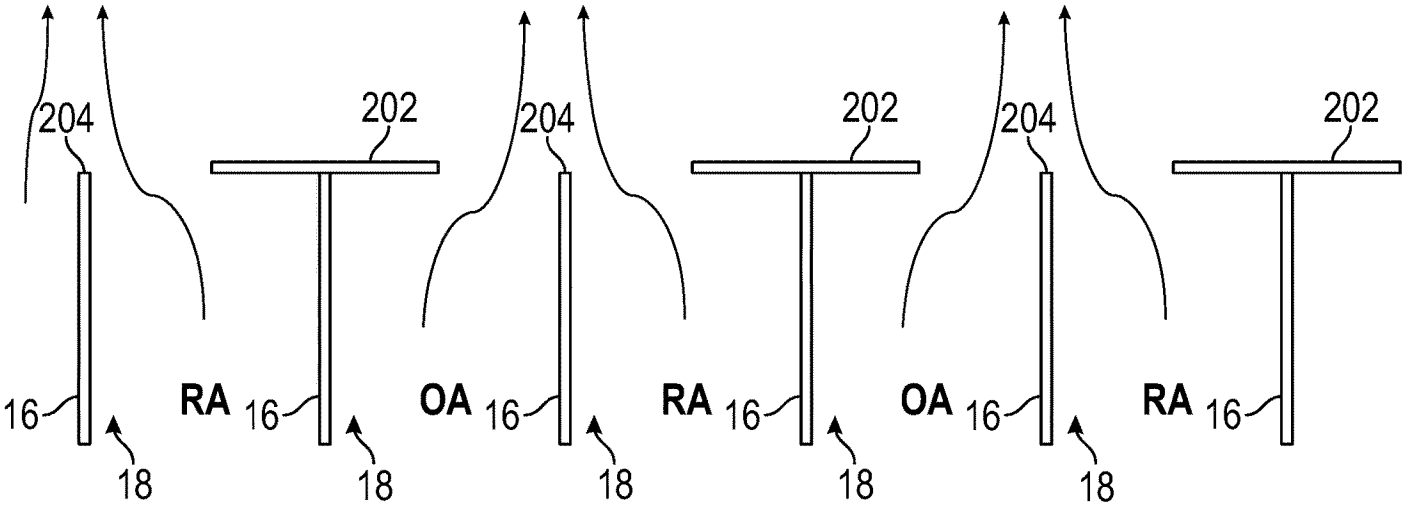
FIG. 23 is an enlarged fragmentary horizontal section of the device of FIG. 21 illustrating how static mixing plates are mounted to the downstream edges of the ribs of the device in order to control airflow and mixing of the airstream.
Figure 24:
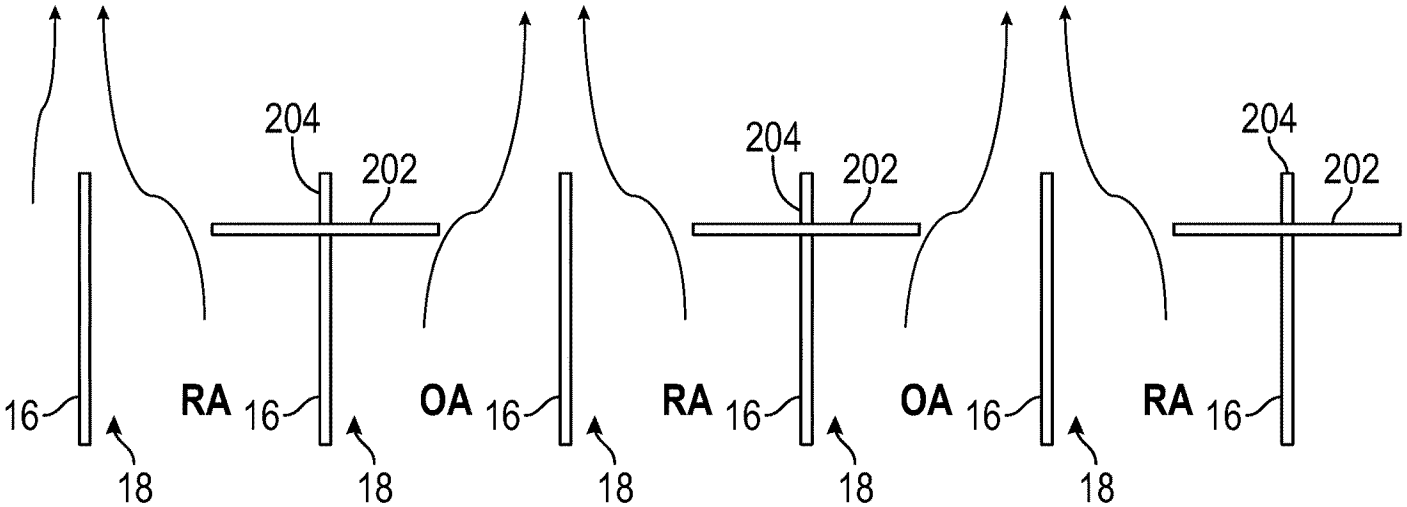
FIG. 24 is another enlarged fragmentary horizontal section of the device of FIG. 21 illustrating an alternate method of mounting the static mixing plates to the downstream edges of the ribs.

Referring to FIG. 23 in 24, in lieu of a cover plate 40, a plurality of static mixing plates or flow disturbance elements 202 may be secured to the downstream edges 204 of selected ones the ribs 16, or may be secured at a selected location upstream of the downstream edges. These figures show the plates/elements 202 as being mounted to every other adjacent rib to cause the two adjacent airstreams to mix; however, it is also contemplated that the plates/elements 202 could be mounted to each of the ribs, or different combinations of ribs. FIGS. 23 and 24 also show the plates/elements 202 oriented substantially perpendicular to the longitudinal axes of the ribs 16; however, it should be understood that the plates the desired mixing as well. Therefore, it should be understood that one or more of the plates/elements 202 may be oriented at a desired angle with respect to the longitudinal axes in order to optimize a desired mixing of the airstreams. Further, the lengths of the plates 202 may be selected to provide the desired cross-sectional areas between adjacent ribs 16 to affect airflow rates through the device. Further, selected plates/elements 202 may have a first angular orientation with respect to the longitudinal axis of its/their corresponding ribs 16, and one or more other of the plates/elements 202 may have a second different angular orientation with respect to the longitudinal axis of its/their ribs 16. Further, each of the plates/elements 202 may have different or the same lengths, or combinations thereof. One advantage of this embodiment is that the mixing device is structurally simplified by the static mixing plates, yet may still achieve desired precision with respect to mixing of airstreams.

Figure 25:
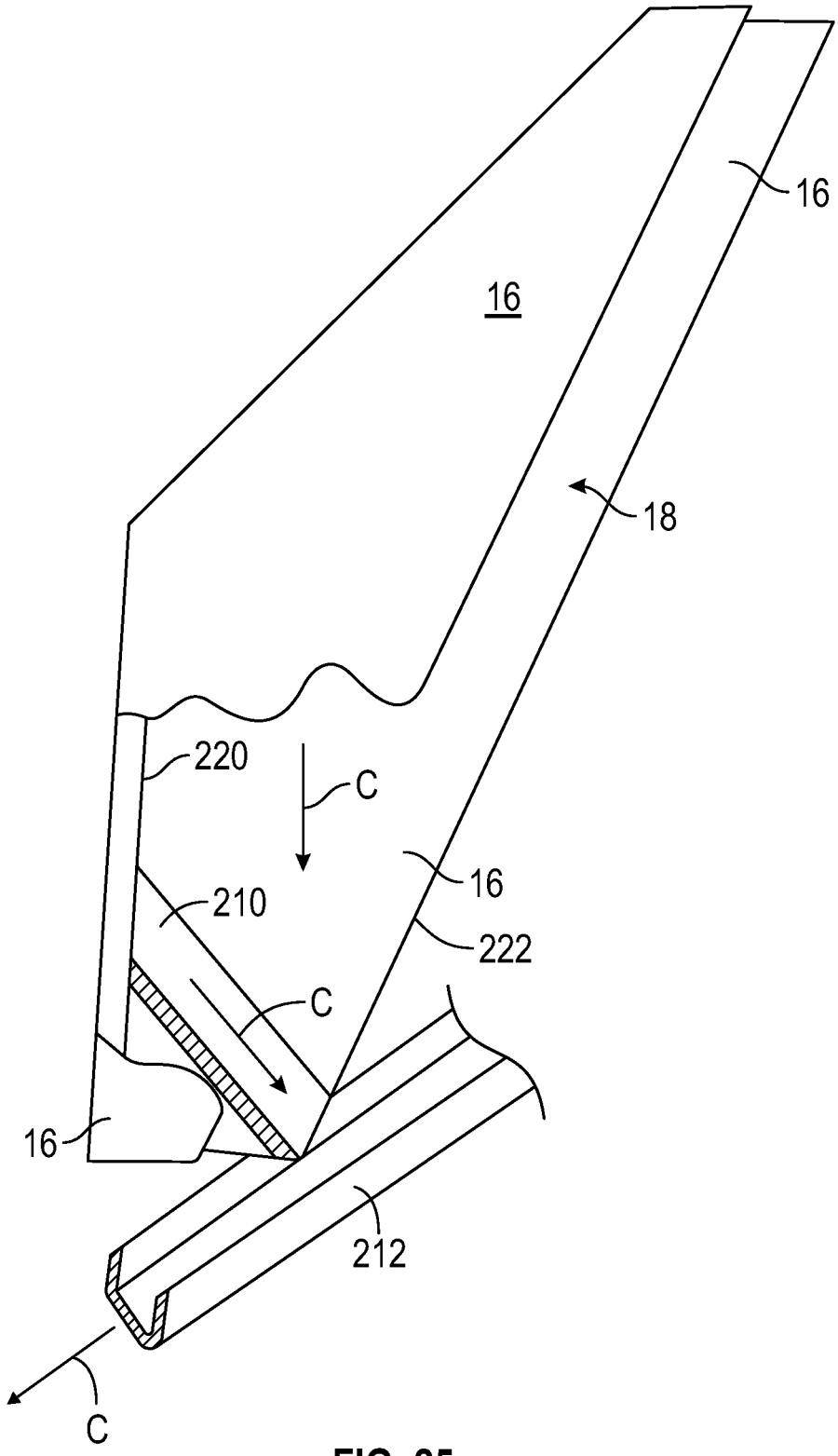
FIG. 25 is a schematic side or elevation view showing an alternate embodiment for the ribs in which the ribs incorporate a channel or gutter to capture condensate that may collect on the ribs, and the channel/gutter communicates with a drain to remove the captured condensate.

FIG. 25 illustrates a modified construction for the ribs 16 to compensate for condensation that may form on the ribs due to the differential in temperatures between the RA and OA. More specifically, two ribs 16 are shown with the rib in the forefront being partially broken away to view a condensation gutter 210 in cross section that is positioned between and joining the pair of ribs 16. The gutter may 210 may have a generally U-shape or V-shape construction in which the opposing and facing external surfaces of the pair of ribs are joined by the gutter 210. As also shown, the gutter 210 is located near the bottom portions of the pair of ribs 16 in which the gutter fully traverses the downstream length of the rib from the upstream edge 220 to the downstream edge 222. If condensation forms on the ribs, the condensation will run down and collect within the gutter 210. The flow of condensation is indicated by the directional arrows C. As further shown, the gutter 210 is oriented downward to cause collected condensation to flow into one or more collection drains 212 which remove the condensate from the mixing box. For simplicity, the collection drains 12 may also have a generally U-shape or V-shape construction, noting the example in FIG. 25 shows the collection drain 212 as U-shaped.

Each adjacent pair of ribs of the mixing device may be joined by a corresponding gutter 210 which spans the gap or channel 18 between the pair of ribs. An alternate construction for the gutters 210 is to secure a separate gutter 210 to each rib in which the gutter partially spans the gap or channel 18 between the adjacent pair of ribs.

Figure 26A:
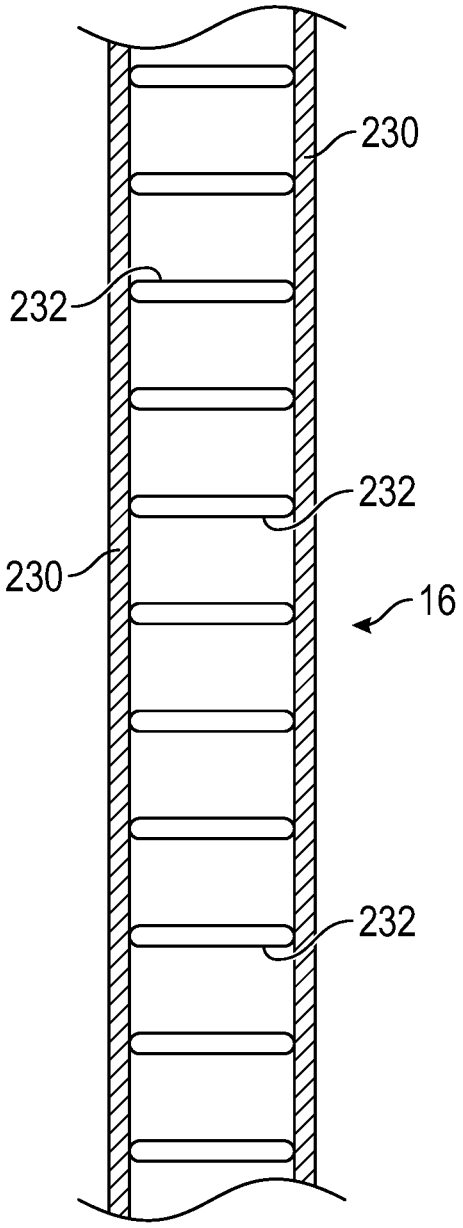
FIG. 26A shows a greatly enlarged schematic cross sectional view of another alternate embodiment for the ribs in which the ribs are constructed of multiple layers to insulate the ribs preventing formation of condensate.
Figure 26B:
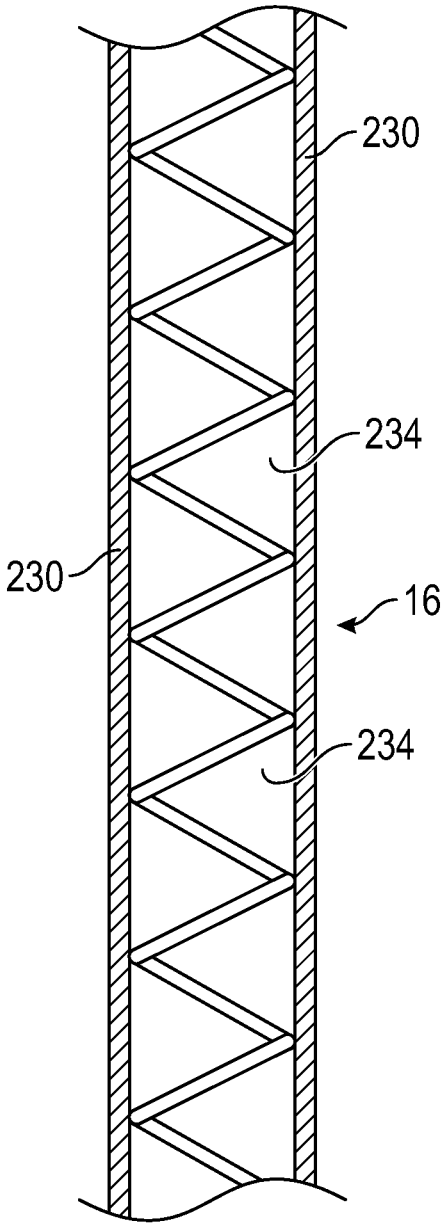
FIG. 26B shows another greatly enlarged schematic cross sectional view of yet another alternate embodiment for insulating the ribs to prevent formation of condensate.

FIGS. 26A and 26B illustrate other modified constructions for the ribs 16 to handle condensation that may form on the ribs. According to these embodiments, the ribs are constructed of two or more layers of material with an insulating gap or space between the materials. The gap may simply be an air space between the layers of material, or the gap may be filled with an insulating material, such as insulating foam. Specifically, FIG. 26A illustrates a rib 16 having a double walled construction, such as a corrugated material in which there are a pair of walls or surfaces 230 and corrugation elements 232 which support and separate the bi-wall construction. FIG. 26B illustrates another bi-wall construction in which the walls or surfaces 230 are spaced from one another and an insulating material 234 is placed between the surfaces.

Providing insulation for the ribs will prevent or significantly reduce condensation from developing on the ribs. In the event of extreme temperature differentials between RA and OA, is also contemplated that the ribs of the mixing device could incorporate both insulating characteristics as well as gutters and drains. Therefore, it should be understood that the embodiments shown in FIGS. 25 and 26 may be used in selected combinations with one another to handle the presence of condensation.

According to one method of the invention, the device of the invention can be used to selectively control airflow through the device such that effective mixing occurs, and that an efficient and effective optimizing function can also be provided by selectively controlling separate airstreams entering through the device, such as outside air and return air. The cover plate actuation can be used as part of an economizer control strategy in which the sliding movement characteristics of the cover plate is designed to behave like a standard set of dampers. The airflow to one airstream increases as the other airstream is proportionately decreased, and therefore, a near seamless integration can be achieved into existing economizer control strategies.

According to another method of the invention, the device selectively controls airflow of separate air streams entering the device by the selective arrangement of ribs and turning vanes. Optionally, a plurality of static mixing plates may be secured to selected ribs to further control the volume and direction of airflow through the device.

Many air handling systems are required to provide a minimum flow of outdoor air to the space that is being serviced. Minimum outdoor airflow requirements are predetermined during the design of the building HVAC system such that an acceptable amount of indoor air quality is achieved. Determining air quality is determined on a variety of standards include both passive and active ways. According to the present method of the invention, a control strategy can be summarized as follows: if the outdoor air is warmer than the supply air set point, the front cover plate will move to a position that allows the minimum outdoor air flow requirement to be satisfied. The remainder of the total required airflow is provided therefore by the return air. As the temperature of the outdoor air drops below the return air temperature, the control system will move the cover plate into a position where the outdoor air channels are fully open and the return air channels are fully closed. As the outdoor air temperature continues to fall, the amount of cooling provided by the cooling coil will be reduced until the coil is turned off. At this point, rather than provide heating as the outdoor air temperature continues to lower, the cover plate is then moved to block more of the outdoor air openings and therefore allowing more flow through the return air openings. As the outdoor air temperature gets colder, the front plate will continue to move until the minimum outdoor airflow is reached. At this point, the heating coil can be activated and the airflow will be heated to provide the correct supply air temperature. This general control scheme can be accomplished through different ways, and complexity varies depending upon the size of the air handler, and the nature of the airstreams being handled.

Based on the foregoing, there are many apparent advantages that should be realized with the device and method of the invention. The device combines attributes of a damper economizer and a static air mixture into one device. A single damper actuator can be used to achieve desired airflow through the device without multiple dampers being required at other locations within the mixing box. The turning vanes provide stiffness to the overall construction of the device. Multiple configurations for the turning vanes can be provided to handle a nearly limitless number of desired airflow situations. Sealing structure is provided so that any incremental shifting of the cover plate is sealed with respect to the facing surface of the device and to therefore precisely control desired airflow. The device of the present invention is typically suitable for use within HVAC systems, it is also contemplated that the device of the present invention is also usable and many other airflow systems. Flow characterization of the passageway for entry of outer air may allow the measurement of the volume of outdoor air passing into the mixing box. This is a function that is currently required in some applications and otherwise requires the use of a flow measurement station built into the duct of the outer air supply. The particular shape of the device can be altered to conveniently match any particular configuration for duct work associated with their entry into the corresponding air handling unit; the shape of the housing can be so adjusted to meet any particular configuration. Better velocity performance has been proven in testing, and further, the device of the invention in certain embodiments shows less pressure drop and many other commercial systems. Because of the ability to selectively alter the position of the cover plate, outside air and return air ducts do not have to be the same size and therefore, the mixing device of the invention is more easily mounted or otherwise configure for mounting within any particular air handling unit.

What is claims is:

1. An air mixing device especially adapted for mixing airstreams introduced to an air handling unit and flowing through said unit, said air mixing device comprising:

a housing;

a plurality of spaced ribs secured to said housing, a plurality of corresponding channels defined as spaces between adjacent ribs, said channels delimiting areas through which airstreams flow through said device, and said plurality of spaced ribs configured to determine a size and shape of said channels;

a plurality of static mixing plates secured to a corresponding plurality of the plurality of spaced ribs; and wherein said static mixing plates are oriented to extend a selected distance into adjacent channels separated by a common rib;

said plurality of spaced ribs include a first set of ribs that communicate with a first airstream introduced to the air handling unit, and a second set of ribs that communicate with a second airstream introduced to the air handling unit; and wherein said plurality of spaced ribs have a length that extend substantially in a first direction and said first and second sets of ribs are offset from one another in a second direction that is substantially perpendicular to said first direction.

2. The mixing device, as claimed in claim 1, further including:

at least one turning vane mounted between two adjacent ribs and spanning a channel located between said adjacent ribs, said turning vane oriented to alter a directional flow of an airstream passing through said channel.

3. The mixing device, as claimed in claim 2, wherein:

said at least one turning vane includes a plurality of turning vanes mounted between selected pairs of adjacent ribs.

4. The mixing device, as claimed in claim 3, wherein:

said plurality of turning vanes each have a selected angular orientation for altering the directional flow of the airstream.

5. The mixing device, as claimed in claim 1, further including:

a channel mounted to at least one of said ribs to catch condensate that may form on the at least one rib.

6. The mixing device, as claimed in claim 1, wherein:

said plurality of ribs are constructed of at least two layers of materials with an insulating gap separating adjacent layers of the materials.

7. The mixing device, as claimed in claim 6, wherein:

said insulating gap is filled with a selected insulating material.

8. The mixing device, as claimed in claim 1, further including:

at least one gutter secured between and attached to at least one rib of an adjacent pair of ribs to capture condensate that may form on the ribs.

9. The mixing device, as claimed in claim 8, further including:

at least one drain communicating with said at least one gutter to receive flow of condensation from said at least one gutter.

10. In combination, an air mixing device and air handling unit wherein said air mixing device is especially adapted for mixing airstreams introduced to the air handling unit and flowing through said unit, said combination comprising:

a mixing box for receiving the airstreams, said mixing box having an outside air inlet, a return air inlet, at least one outside air damper mounted within said outside air inlet and at least one return air damper mounted within said return air inlet;

an air mixing device mounted in said mixing box, said device including: (i) a housing; (ii) a plurality of spaced ribs secured to said housing, a plurality of corresponding channels defined as spaces between adjacent ribs; (iii) a plurality of static mixing plates secured to selected corresponding downstream portions of said;

a heating unit located downstream of said air mixing device;

a cooling unit located downstream of said air mixing device;

said plurality of spaced ribs include a first set of ribs that communicate with a first airstream introduced to the air handling unit, and a second set of ribs that communicate with a second airstream introduced to the air handling unit; and wherein said plurality of spaced ribs have a length that extend substantially in a first direction and said first and second sets of ribs are offset from one another in a second different direction.

11. The combination, as claimed in claim 10 further including:

a channel mounted to at least one of said ribs to catch condensate that may form on the at least one rib.

12. The combination, as claimed in claim 10, wherein:

said plurality of ribs are constructed of at least two layers of materials with an insulating gap separating adjacent layers of the materials.

13. The combination, as claimed in claim 10, wherein:

said insulating gap is filled with a selected insulating material.

14. The combination, as claimed in claim 10, further including:

at least one gutter secured between and attached to at least one rib of an adjacent pair of ribs to capture condensate that may form on the ribs.

15. The combination, as claimed in claim 14, further including:

at least one drain communicating with said at least one gutter to receive flow of condensation from said at least one gutter.

16. An air mixing device especially adapted for mixing airstreams introduced to an air handling unit and flowing through said unit, said air mixing device comprising:

a housing;

a plurality of spaced ribs secured to said housing, a plurality of corresponding channels defined as spaces between adjacent ribs, said channels delimiting areas through which airstreams flow through said device, and said plurality of spaced ribs configured to determine a size and shape of said channels;

a plurality of static mixing plates secured to a corresponding plurality of the plurality of spaced ribs;

said static mixing plates are oriented to extend a selected distance into adjacent channels separated by a common rib;

said static mixing plates are selectively angled with respect to a downstream longitudinal axis along which the ribs extend; and wherein said static mixing plates are oriented at an acute angle with respect to the downstream direction.

17. The mixing device, as claimed in claim 16, wherein:

said static mixing plates are angled substantially perpendicular to the downstream direction.

* * * * *